US006315054B1

(12) United States Patent
Brunet

(10) Patent No.: US 6,315,054 B1
(45) Date of Patent: Nov. 13, 2001

(54) ASSEMBLY AND METHOD FOR LOCATING LATERAL WELLBORES DRILLED FROM A MAIN WELLBORE CASING AND FOR GUIDING AND POSITIONING RE-ENTRY AND COMPLETION DEVICE IN RELATION TO THESE LATERAL WELLBORES

(75) Inventor: Charles G. Brunet, Houston, TX (US)

(73) Assignee: Weatherford Lamb, Inc, Houston, TX (US)

( * ) Notice: Subject to any disclaimer, the term of this patent is extended or adjusted under 35 U.S.C. 154(b) by 0 days.

(21) Appl. No.: 09/556,664

(22) Filed: Apr. 24, 2000

Related U.S. Application Data

(63) Continuation-in-part of application No. 09/407,710, filed on Sep. 28, 1999, now abandoned.

(51) Int. Cl.[7] ..... B21B 23/02

(52) U.S. Cl. ..... 166/387; 166/117.5; 166/182; 175/61

(58) Field of Search ..... 166/387, 117.5, 166/117.6, 123, 124, 313, 50, 134, 175, 180–182; 175/61, 62

(56) References Cited

U.S. PATENT DOCUMENTS 4,415,205 11/1983 Rehm et al. .
5,458,209 * 10/1995 Hayes et al. ..... 175/61
5,579,829 12/1996 Comeau et al. .
5,785,133 * 7/1998 Murray et al. ..... 175/61

* cited by examiner

*Primary Examiner*—David Bagnell
*Assistant Examiner*—Zakiya Walker
(74) *Attorney, Agent, or Firm*—Parks & Associates P.C.

(57) ABSTRACT

Assembly and method for locating lateral wellbores in a main wellbore casing for positioning completion members in the lateral wellbore and the main wellbore casing and for orientating and positioning reentry and completion devices into the lateral wellbores comprising a window formed in the wellbore casing which is defined by a sill being convergently curved up hole to the sill up hole apex, a second wellbore located proximate and in communication with the window, a tubular string and a housing member movable in the wellbore casing and connected to the tubular string, orientation and positioning member connected to the housing for orientating and positioning the housing relative to the window upon up hole movement of the housing and tubular string toward the up hole apex of the sill and tools for completion, work over, reentry, and reentry and completion being attached for their respective functions.

100 Claims, 22 Drawing Sheets

Fig. 3
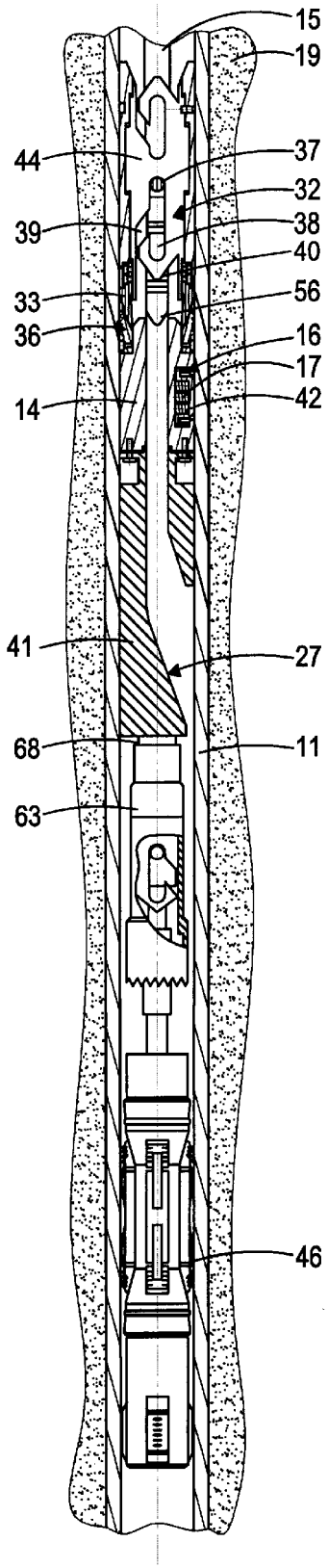
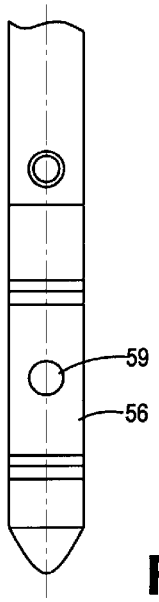
Fig. 3a

ASSEMBLY AND METHOD FOR LOCATING LATERAL WELLBORES DRILLED FROM A MAIN WELLBORE CASING AND FOR GUIDING AND POSITIONING RE-ENTRY AND COMPLETION DEVICE IN RELATION TO THESE LATERAL WELLBORES

RELATED APPLICATION

This application is a continuation-in-part of application from Ser. No. 09/407,710, filed Sep. 28, 1999, now abandoned.

FIELD OF INVENTION

The present invention relates and discloses assemblies and methods for locating lateral wellbores drilled from a main wellbore casing for positioning members with respect to the lateral wellbore and the main wellbore casing and for orientating and positioning reentry, completion and workover devices for entry into the lateral wellbores. These assemblies and methods include generally the presence of a first wellbore casing, a window formed in and through the first wellbore casing and a sill of the window formed in the first wellbore casing defining the window in the first wellbore casing and with the sill being convergently curved up hole to form an up hole apex in the first wellbore casing, at least a second wellbore proximate and in communication with the window and extending from the first wellbore casing, a tubular string, a housing member movably disposed in the first wellbore casing for being run into the first wellbore casing by the tubular string and connected to the tubular string, orientation and positioning members connected to the housing member for orientating and positioning the housing relative to the window upon up hole movement of the orientation and positioning member, and completion tools connected to the tubular string for movement into the first wellbore casing for completion. This present invention further includes devices connected to the tubular string for movement into the first wellbore casing and at least a second wellbore, and has selective separating mechanisms connected to the housing member for selective separation of the devices connected to the tubular string for allowing their movement into the second wellbore. Also this present invention further includes deflector members connected to the housing for deflecting the devices for reentry, workover, and reentry and completion as the devices and tubular string are selectively separated from the housing and advanced down hole into the deflector members and deflected by the deflector member into the at least second wellbore member. Further this present invention includes the presence of a deflector connected between the completion tools set above and below the at least second wellbore member which are set in the main wellbore casing for allowing reentry of tubing into the at least second wellbore member at any time after the setting of the completion tools in the main wellbore casing. Also this invention includes a sleeve with at least one seal for being moved into position to close the window from communication with the second wellbore to protect the second wellbore from being damaged from activity in the main well bore. Further this present invention provides a release for disengaging the orientation and positioning member to allow movement and removal of the orientation and positioning member out of the window for movement of the housing member in the well when desired.

1. Background of the Invention

Drilling and completion of horizontal wells in recent years has resulted in the dramatic improvements in the production and recovery of hydrocarbons from both new and older wells. Although horizontal wells have been accepted by the industry as a proven and cost effective means to increase production and maximize ultimate recovery of hydrocarbons from a reservoir while lowering the cost, they are expensive. It has, however, been proven that although horizontal wells cost significantly more to drill and complete than vertical wells, a horizontal well frequently improves production by a factor of 5 to 10 times in suitable reservoirs, such as those which are naturally fractured or in heavy oil applications. The economics associated with horizontal drilling are so favorable in many areas of the world that the drilling of vertical wells in these areas has become relatively rare. The increases in both the production and ultimate recovery of hydrocarbon reserves associated with horizontal drilling generally minimizes the number of well locations and infrastructure required to develop an oil and gas field. This is particularly important in high cost or environmentally sensitive areas, such as offshore locations, where reducing the number of platforms often results in significantly reduced investment and lower operational costs. Other areas which are particularly applicable for horizontal development include reservoirs in urban areas, wildlife preserves, and permafrost zones. In addition horizontal drilling allows optimization of water injection efficiency and the development of thin, stacked reservoirs that would otherwise require many vertical wells, as well as reservoirs with coning problems, in which horizontal drilling allows laterals to be optimally spaced for the fluid contact.

The industry has come to accept that multilateral wells are the most cost effective means to deliver horizontal wellbores. In addition this multilateral approach minimizes the environmental impact and amount of surface infrastructure required to develop an oil field. The reason is simple. A multilateral well allows multiple hydrocarbon reservoirs to be developed through the drilling of only a single main wellbore. Thus by using many lateral wells ie., multilateral wells, the advantages of horizontal drilling can be maximized on a single main well bore.

As a result of this multilateral wells have become increasingly popular over the last few years, both in the application as new wells to develop fields, as well as in the reentry of existing wells in established fields to increase production through stimulation, workover, and deepening activities. This increase is largely due to the lower oil and gas pricing levels that currently exist, which is therefore driving the industry to utilize the most cost effective means to produce hydrocarbon reserves. In addition, public awareness of the impact that drilling and production operations have on the environment has provided an additional incentive for the industry to minimize the number of wells and infrastructure required to develop oil & gas reserves. However, until recently individual laterals were not cased or tied back to the main production casing. This meant that it was difficult or impossible to reenter these laterals in the event that a workover, clean out or stimulation was required.

The technology now exists to drill, tie back and complete multiple laterals in vertical, deviated, directional or horizontal wells either at the time the well is drilled or at a later time in the life of the well. More than one lateral can now be "kicked off" at the same elevation of the main wellbore casing, and there is no limit as to how many laterals can be installed from a single main casing. Using this multiple lateral technology a customized drainage architecture can be installed which minimizes the distance that the hydrocarbons must travel to reach the wellbore and assures that the reservoir can be produced in the most efficient and cost effective manner. However in order to receive the full benefits of these advancements in the drilling technology, the laterals or multilateral must be able to be selectively reentered quickly and reliably, and completed in a cost effective manner.

For the above mentioned reasons, the industry is placing ever increasing dependence on multilateral well completions. As such, there is a great demand within the industry for advancing the technical capabilities of the completion systems which are available. The completion technology for the installation of lateral junctions in competent formations is well known. A primary barrier to the increased use of multilateral technology has been limitations in the completion options available, particularly in those situations in which a sealed junction is required to effectively produce a reservoir. Situations in which hydraulically sealed lateral junctions are desirable include unconsolidated or weakly consolidated formations, in order to avoid collapse of the junction or in those junctions in which water injection is planned, or when the influx of formation fluids into the primary casing is unacceptable.

Laterals can be installed at the time the well is drilled or may be added at a future time if it is determined that incremental reservoir exposure is needed and drilling operations determine that additional reservoirs may be accessed from the same wellbore. It has recently been increasingly popular to tie back the laterals to the main casing. Whether or not the laterals are tied back, the industry has placed increasing importance on being able to selectively reenter these laterals for workover or deepening operations.

To date the industry has primarily used standard packers and other stock equipment to complete these laterals and multilaterals. In the most common form of completion cement is pumped into the space between the annulus and the lateral's casing, just as completion in done in the main well bore casing. The result has been less than satisfactory with numerous problems encountered in placing the completion equipment in the correct spacing and orientation in relation to the laterals as well as controlling the flow of the completion fluids, such as cement, which is pumped into for the completion. This has often resulted in great expense being incurred to successfully complete the installation.

In addition the completion equipment currently available in the industry requires installation in a "bottom up" sequence, starting at the lowest lateral or multilateral in the main wellbore. Removal of the completion equipment must be undertaken from the "top down" beginning at the highest lateral in the main wellbore. Once finished, the completion is difficult or impossible to re-install if the packer or packers in the main wellbore used for orientation to the laterals are moved or removed, because the packers generally carry a member which is mounted in a known orientation off of which an operator could key to find the position and orientation of the window and the lateral wellbore. The difficulty in installing completion equipment in this manner increases dramatically with the number of laterals or multilaterals in a well.

Also in the industry today, when there are multiple completions in a well there is a constant potential problem of having materials from one lateral completion damage the main wellbore or material from the main wellbore damage the laterals during the sequence of completion. Even in the process of just doing one lateral completion the industry has had problems on occasions with the completing material ending up in the main wellbore and causing damage to the lateral in the process of circulating them out of the main well bore casing.

In addition the majority of the means currently available to install completion and reentry assemblies is limited to installations from a fixed non-moving platform, such as the rig floor of a land rig, jackup or platform rig, due to the way the downhole devices must be oriented and latched. This can render the equipment useless or of little use for installations from a moving platform, such as a floating rig or drill ship, which may move many feet up and down because of the wave action of the sea. These installations which are initiated from a moving platform can add additional time and great expense to the process of completion and reentry. In the non-moving platforms the drill string and the reentry equipment is generally operated in compression by the drill string and reentry equipment being pushed down hole against the area where reentry is to occur. As will be obvious to those skilled in the art, when the platform is moving up and down the compression down hole of the reentry equipment is difficult to maintain.

Multilateral systems that employ pre-milled windows generally have remotely located slots that are engaged by the spring loaded lugs located on the whipstock which insure correct orientation to the window opening. These slots may be either tubular or rectangular in nature, and are located below the window opening. However these slots are limited to new wells as they must be installed in the casing string prior to the time that the casing is run and the well completed. Further on some occasions these lugs have been know to lock up and prevent the completion equipment from being pulled from the well bore and required that the equipment be drilled out of the well bore.

In regards to reentry of existing wells the general approach has been to set a packer below each window. This packer is then used to land, anchor, and orient the whipstock for both the drilling operations as well as any reentry of the lateral for workover or stimulation operations. However allowing this packer to remain in the well restricts or eliminates the ability to access the wellbore below this point. Alternatively removing the packer eliminates the possibility of reentering the lateral at a later date.

More recently systems have been introduced to allow some type of deflection device to land and anchor at the bottom of the main window to allow reentry of the lateral for workover purposes. The drawbacks of such systems include inherent inaccuracies in placement with respect to the lateral wellbore and unreliability in securing the deflection apparatus involved due to the inexact nature of windows which are milled downhole. Also compounding that problem of accurate placement are the inherent problems associated with setting deflection apparatus in compression such as "cork screwing" and/or having a "spring effect" on long runs of working strings in deep or highly deviated wells wellbore. Jagged, rough edges, and metal shavings can, also, prevent the proper setting and alignment of reentry or completion tools currently available.

Up to this time most re-entry systems have relied on packers or some other type of anchoring device located below the bottom of the window to land and orient reentry devices. This creates an inherent problem as these systems require accurate landing in compression of a whipstock or some other deflecting device. This landing in compression can be difficult in very deep or highly deviated wells, because of "cork screwing" and/or the spring nature of long runs of working strings which can cause the landed device to bounce off the bottom section. In addition, the completion is difficult or impossible to reinstall if the packers in the main wellbore used for orientation to the laterals are moved or removed, because the packers generally carry a member which is mounted in a known orientation off of which an operator could key to find the position and orientation of the window and the lateral wellbore.

2. Prior Art

Although the number of prior art laterals being installed has increased dramatically over the last few years, problems associated with laterals and particularly multilateral wellbore reentry and completions have been recognized for many years as reflected in the patent literature. However part of these problems can be attributed to their usage in more and varied well conditions and at more extreme angles of deviation from the vertical wellbore than ever before. While many techniques to solve a number of these problems have been developed, additional and different problems have also been created. For example now there exists a need for providing a simple and universal assembly or assemblies and method or methods which can be used for the drilling, completion, workover, and reentry at a later date of a lateral or multilateral wellbore.

In the case of U.S. Pat. No. 4,415,205 which discloses index mechanisms for locating and orienting tools for formation of lateral well bores on the inside of the well bore and casing, which project inwardly to locate and orient the whipstock and other tools for drilling a lateral well, it is a problem. The problem with these internally projecting keys, which function by extending radially inward from the casing wall for orienting and positioning a whipstock, is the restriction they create in the internal clearance through the casing. This is a problem because it limits the operating diameter of the well bore which restricts the ability to operate other tools in the well when needed. Further because of the large forces used in wells with the pipe and tools being moved up and down, these internal projections are subject to being damaged or destroyed by tools working in the casing, which would render the projections useless for their intended purpose. Thus the expense of a window section would be completely lost, as well as access to that oil bearing strata, without great additional expense.

While the prior art has used spring loaded key in various forms they were usually complex arrangements which were difficult to use and in some cases unusable if at all in certain applications. For example in the prior at U.S. Pat. No. 5,579,829 for locating and orienting operations related to formation of these lateral well bores, these devices were equipped with multiple sets of keys which must mate with permanently mounted key receivers located in the main casing. This could be a relatively complex arrangement and procedure and it required diligence and precision in placing the correct combinations of keys in the system accurately. Also it required a very detailed and complicated record keeping procedure for any future work which might be done in the well. Also as the various key-receivers for each well could be different it required the maintenance of a large inventory of each key system and thus this problem grows as the number of such systems is increases around the world.

The prior art has many approaches to solve this problem but most of them have required the mounting of keys, keyways, slots and packers permanently on the inside of the well bore and casing. When such items are mounted on the inside of the casing they are restricting access to some of the well producing zones below the point where these items are mounted. Further any system which restricts the operating diameter of the well bore also restricts the ability to operate other tools in the well below the area where a lateral has already been drilled. Due to the large forces used in wells created by the pipe and tools being continuously moved up and down, any internal projection is subject to being damaged or destroyed, which would render the projection useless for its intended purpose. This is especially true for reentry of a drilled lateral at a later date for workover, clean out, deepening or stimulation of this lateral. Thus the expense of the first lateral well drilled could be completely lost, as well as access to that oil bearing strata without undertaking great additional expense.

Clearly multilateral drilling assemblies which have come under use in deeper and more complex older wells are more likely to have problems associated with retrieving and manipulating them in the well bores and successfully completing a lateral. This is because the record keeping associated with these wells may have been lost or even if it exists, may not be accurate as the records which are kept today. It is also more likely that numerous reentries or production operations undertaken in these wells over the years may have led to damage of the casing in certain areas around the lateral junction. The junction is the place where the main well bore casing and lateral intersect, and if not accurately entered and reentered, it can suffer damage.

A further problem in the older prior art of multilateral wells was finding the exact location of the window and the orientation of this window for the setting of completion equipment, such as packers, to allow production of that lateral well. This is especially true in older multilateral wells when they were drilled to great depths and/or they were trying to be located from a moving platform, such as a drilling vessel etc. In the case of older deep wells, for example a 10,000 foot deep well, elasticity will occur in the drill string which can represent several feet of movement or "slack" between the surface and the downhole position of the running tools when trying to find the window with those running tools. In the case of moving platforms, for example a drilling vessel, the movement is further compounded by the motion of the sea on the vessel plus the "slack" in the drill string. Also in these deep wells and those being accessed from a drilling vessel, the finding of the window in the main wellbore casing is even further compounded by helical sections or "cork screws" being formed from the previous drilling operations in the main well bore. Thus in the prior art which was deep and/or was being conducted from the drilling vessel in wells which had "cork screws", there were significant problems of using spring loaded keys utilizing multiple sets of keys which must mate with mounted key-receivers located in the well because the mating process could be complicated by the arrangement and require diligence and accuracy in selecting and installing the correct key system, especially under all the conditions of "slack" and/or drilling vessel motion and the attendant "cork screw" effects. Clearly this would require detailed and complicated record keeping to even have a chance for the procedure to work for any future work which might be done in the well.

In the prior art systems which used spring loaded keys, the keys are easy to engage once the key was directly over the key hole or key way, but these key holes and key ways were normally of relatively small square surface area and a significant amount of time could be required for manipulating the drill string and tools to find the exact position to allow the key to spring out and mate with key hole and key ways so that further work could be done. In most case the key had to hit key holes and key ways with target areas measured in 25 to 50 square inches which is relatively small when you consider the "slack" and movement possibilities of a lateral well at a 10,000 foot depth.

Also in the prior art, keys set in small key ways were subject to hanging up in these small key ways and thus locking the whole assemblies of the prior art in the well. When this locking up occurred it necessitated the use of expensive procedures to remove these assemblies, such as drilling the assemblies of the prior art out of the well bore. In the process of drilling out the prior art assemblies from the well bore, the very process left many small metal cutting in the well, which as those skilled in the art will recognize can create problems in the well.

Another problem for the prior art which used keyways was they often had small target key ways. Many times the target areas filled with debris from the well, such as metal shavings which were generated from earlier milling operations or formation cuttings which were generated when the lateral was drilled, or formation cutting which were generated during the production operations, therefore the target key way could not be found and the lateral could not be reentered except with additional runs to clean the key way. As these key ways had small cross sectional area and were generally located down hole in a well they were very easy to fill with debris.

Also in the prior art many of the keys were set in the key ways in compression by just letting down on the tubing string to hold the key in the key way by those compressive forces which were generated by just letting down on the key with the weight of the drill string. However in wells which are mounted on drilling vessels this was a problem, even if the ship had wave compensators, because it is difficult to hold 10,000 feet of tubing sting in compression for the purpose of holding the key in the key way at such deep wells.

In most of the prior art the only way to find and reenter an old lateral in a well once it has been drilled and completed was by leaving the whipstock, packer and other orientation devices in the well. Leaving any of this equipment in the well would block access to any of the laterals which are below this device, or even in accessing the main wellbore below this point. Leaving this equipment in the main wellbore often was not acceptable, but unfortunately removing this equipment left few, if any, means of identifying the entrance to the lateral and eliminated the opportunity to reenter the lateral.

Yet another problem in the prior art involved whipstocks, packers and any other devices for lateral orientation and guiding purposes which had to be installed starting at the bottom of the well and moving up the well to the next multilateral. In this prior art, it became very tedious, difficult and expensive to remove these devices located at the lower parts of the main wellbore should that be required in the future. Furthermore it was difficult or impossible to reinstall this equipment, once removed from the old wells, in the proper location and orientation to allow the reentry or correct installation of completion equipment.

Because in the prior art many of the prior art keys or keyways were located down hole and were affixed to the casing or tubular walls, they were subject to being damaged or destroyed by other work that had occurred in the well since the drilling of the lateral well. Also even if reentry was possible with the damaged keys or keyways, the accuracy of reentry was subsequently not very good or reliable and while it maybe achieved it was done only with corresponding wear and tear on the window and key systems which later rendered them unusable in the future.

The fact that many of the prior devices, keys, keyways, slots, packers, or surfaces used to anchor the deflecting devices for use in the reentering of the window were always located at a point in the wellbore that was below the window, required usage of whipstock devices which were heavy and expensive to handle and run. These large and heavy whipstocks introduced the further risk that they would get stuck in the well and require special runs to clear them so that the lateral completion process could continue. Further more these large whipstocks in the main well bore casing prevented access to any laterals or the main wellbore at any point below this whipstock while in the well.

While the prior art is repeat with patents for the reentry into a lateral or horizontal well bore hole or completion of a lateral wellbore within the main casing which by definition means to reenter the lateral wells, they generally all required that the structure used to form the lateral be present to achieve the reentry or completion of the lateral. Thus most of the prior art patents do not disclose the reentry of a completed lateral where the structure used for making the lateral has been removed. Those which did attempt to complete a lateral not using the structure used in the creation of same disclosed methods and apparatus for reentering a lateral wellbore, as in U.S. Pat. No. 5,651,415, which required measuring the distance from a fixed point in the wellbore below the window and included an inflatable packer with an outside memory retention surface and a tail joint to orient the assembly for reentry tools needed for the reentry into the lateral well bore. Further methods, such as this one, to achieve reentry have required a minimum of three trips of the drill string into the wellbore or the use of logging equipment. When logging equipment was used it meant an electric logging unit was called out to the well site, which may be very expensive. Further the electric logging units are not always available on short notice which could both delay the process of reentry and drive up the costs of the well.

OBJECT OF THE INVENTION

It is the object of this invention to provide an assembly and method for locating a lateral wellbore drilled from a main wellbore casing for positioning members with respect to the lateral wellbore and the main wellbore casing and for orientating and positioning reentry, completion, and workover devices for entry into the lateral wellbores which eliminate or improve over the deficiencies, drawbacks and shortcoming in the prior art.

One of the objects of this invention is to allow the orientation and positioning of the key member of this invention to engage various types of orientation profiles or windows in wellbore casing, whether the profile or window has been precut on the surface or alternatively, whether it consists of the natural profile which remains after a profile or window opening has been milled downhole. Thus this invention allows the universal use of various types of reentry or completion apparatus to be oriented and positioned in relation to the window and lateral wellbore without the need for specialized completion devices or reentry members. The elimination of specialized completion or reentry members which are application specific eliminates the need for very expensive and hard to get equipment in the process of completion or reentry and/or completion of wells.

Further it is the object of this invention to position and orient key members for locating the profile or window opening in the main wellbore casing which eliminates the need for orientation packers devices or other obstructions to be located in or alternatively to project into the main well bore casing which reduce the inside diameter of the main well bore casing.

Also it is an object of this invention to eliminate the need for special orifices for orientation and positioning in the main wellbore casing and to make use of the profile or window orifice in the main wellbore casing to selectively re-enter a lateral for a workover or stimulation activities without the need for a packer device or other orientation means to remain as an obstruction in the main wellbore casing after the drilling, workover or stimulation operations are completed.

It is yet a further object of this invention to make use of the profile or window orifice that exist within a window opening in the main wellbore casing without the need to leave an obstruction, such as an orientation packer, in the main wellbore for future location and orientation of reentry of the lateral wellbore after the well is completed.

Another object of this invention is to eliminate index mechanisms for locating and orienting tools for formation of lateral well bores on the inside of the main well bore casing, which project inwardly to locate and orient the whipstock or other tools for drilling a lateral well, such that there is no internally projecting keys or members to be used for orienting and positioning a whipstock and thus no limitation of the operating diameter of the main well bore casing would exist to restrict the ability to operate other tools in the well when needed.

Also as an object of this invention is the elimination of these internal projections into the main wellbore casing, because the wellbore could have large tools with great forces used which makes such internal projections subject to being damaged or destroyed by the large tools working in the casing, which would render the projections useless for their intended purpose and possibly cause complete loss of access to the window and the oil bearing strata without great expense.

Yet a further object of this invention is to provide an orientation and positioning key system to locate the profile or window opening in the main wellbore casing in order to eliminate the need for an orientation packer device or other obstruction to remain in the main wellbore casing for the purpose of locating or orienting with respect to the lateral well bore. This invention also eliminates the requirement to use pipe measurements or wireline as methods to locate the window opening.

A further object of this invention is to land an orientation and positioning key member at or near the upper most point on the window sill surface, substantially the apex of the profile or window or in an apex member formed as a channel member to receive the orientation and positioning key member upon the key member being moved up hole for the purpose of locating and/or orienting with respect to the lateral. This invention thus eliminates any requirement to use pipe measurements or wireline methods to locate the window or the use of an orientation packer means or any other specialized equipment in the main wellbore casing.

In addition it is yet a further object of this invention to provide a key member which will not hang up in the well and therefore not require the key member and housing to be removed by drilling them out of the well. The key member of this invention is prevented from hanging up in the well by providing a downhole surface on the key member which will cause the key to move inward upon down hole movement of the key member and the housing in the main well bore. Further it is an object to have the key member constructed to provide a break away surface section on the key member, which if all else fails, may be broken away into small pieces just by applying greater up pressure on the working string to cause the break away surface section to release and free the housing and remainder of the key body to be pulled from the well bore or freed up for other activities in the well.

Also it is a further object of this invention to provide the methods and assemblies to allow the correct placement in relation to the juncture of a lateral and the main wellbore casing of devices for reentry and completion assemblies, and further for said correct placement to be positively confirmed on the surface by the well operator.

Still a further object of this invention is to provide a method and assembly to allow a lateral to be quickly, inexpensively, reliably, and selectively reentered for the purposes of workover or stimulation activities.

In addition it is yet a further object to this invention to provide methods and assemblies to allow the juncture of a lateral to be quickly, inexpensively, reliably, and selectively completed for producing hydrocarbons.

It is also an object of this invention to provide methods and assemblies for forming a cemented seal at the junction of the lateral wellbore and the main wellbore casing while at the same time completing the lateral wellbore.

Yet a further object of this invention is to provide the methods and assembly to allow a lateral to be selectively reentered in a manner that gives a positive confirmation on the surface that the reentry assembly is correctly oriented and positioned in relation to the lateral.

Also an object of this invention is to provide methods and assemblies to allow the reentry or completion of the lateral in a single trip of the work string, thereby greatly reducing the cost associated with this type of installation due to the savings in rig time.

In addition, it is an object to provide the methods and assemblies to allow the reentry and completion with a cementing operation in the lateral wellbore and lateral well casing while at the same time forming a cemented seal at the junction of the lateral wellbore and the main wellbore casing and achieving this in a single trip of the work string, thereby greatly reducing the cost associated with this type of installation.

Yet a further object of this invention is to provide methods and assemblies to allow completion of the main wellbore casing on a single trip of the work string, and at the same time put in place a whipstock for allowing reentry into the lateral at a later time, in a single trip of the work string, thereby greatly reducing the cost associated with this type of installation.

It is another object of this invention to provide the assembly and methods to allow the setting of the key member in the profile or window under tension between the window and the surface to allow a lateral wellbore to be reentered or the lateral juncture to be completed from a floating vessel with movement even in possibly hazardous weather conditions when high seas would make this extremely difficult or impossible using conventional means, and further to have positive confirmation on the up hole platform surface that the correct orientation and positioning of the downhole assembly with relation to the lateral well has been achieved.

It is also an object of this invention to provide methods and assemblies to allow the reentry or completion assemblies to be set in tension, which eliminates the problem often found in deep or highly deviated wellbores in which the tubing string bends, sags or "corkscrews" making it difficult or impossible to manipulate the reentry or completion assemblies on the end of the tubing or to land and orient them with or with respect to the packer members already in the wellbore.

A further object of this invention is to allow the multiple laterals in a main wellbore casing to be completed in a "top down" architecture, which greatly reduces the cost and risk associated with the present architecture of "bottom up" completions, thus eliminating or reducing loss in the use of all of the lateral located below that point if failure occurred during the completion of an upper lateral.

In addition it is an object of this invention to provide methods and assemblies to allow a large "target" for the orientation and positioning of the key member. In this invention the whole window opening is used as the "target" to engage the orientation key member, in order to eliminate or minimize the problem of finding of the target and the problems associated with smaller control orifices. Thus such difficulties as locating the orifice or the orifice filling up with cement or drill cuttings which make the location and engagement difficult if not impossible on occasion, is eliminated.

Yet a further object of this invention is to provide a deflector member which contains a sealing member which may be activated to isolate the lower part of the main wellbore casing including any laterals which may emanate therefrom, from any potentially damaging exposure to the drilling or completion fluids or debris which may be generated during the drilling workover or stimulation activities.

In addition it is yet a further object of this invention to provide a sleeve which covers the lateral well bore and the window and has at least one seal below the window during a portions of the completion process to prevent damage to the lateral, but which allows the circulation of fluids below the window and the at least one seal member on the sleeve to wash or circulate completion fluids or other materials out of the well.

It is also an object of this invention to provide an orientation and positioning member in the profile or window which is open down hole in such a manner that allows gravity to prevent the trapping of cement or drill cuttings and other extraneous matter which may be found in wells but which further provides an easy way to clean the orientation and positioning member by running the key member into the orientation and positioning member to effect self cleaning when it is being used to orient and position the completion member or reentry and/or reentry and completion member.

Also an object of this invention is to provide methods and assemblies to allow the completion of two laterals in a single trip, thereby greatly reducing the cost associated with this type of installation due to the savings in rig time.

A further object of this invention is to provide methods and assemblies to allow two laterals, commonly known as a dual completion, to be completed, with the short string of production tubing being oriented to the uppermost lateral and the long production string being oriented to a lateral which is located further down the main wellbore casing.

Further an object of this invention is to provide methods and assemblies to allow the reentry or completion of lateral wellbores that are not limited by the number of lateral wellbores emanating from a single main casing.

A yet further object of this invention is to provide methods and assemblies to allow selective reentry of either lateral in a dual completion, thus greatly reducing the expense and uncertainty normally associated with this activity.

It is a further object of this invention to allow a lateral to be reentered through the production tubing, thus saving the time and expense associated with a workover rig having to be brought in and set up.

Also an object of this invention is the correct positioning of equipment to allow the cementing of the lateral at the junction to close of the junction point of the main wellbore and the lateral and for allowing the reentry of the lateral after the cementing of the junction has occurred or at a later time.

Yet further and additional benefits and improvements of the invention will be appreciated by others skilled in the art and those advantages and benefits of the invention will become apparent to those skilled in the art upon a reading and understanding of the following detailed description and drawings.

BRIEF DESCRIPTION OF THE DRAWINGS

This invention may be practiced in certain physical forms and arrangements of the parts herein described, but a preferred embodiment of which will be described in detail in the specification and illustrated in the accompanying drawings which form a part hereof.

FIG. 3 shows a cross sectional side view of a housing member being run into a first wellbore casing with the orientation and positioning key compressed against a spring and being located between the housing and the casing and the selective separating J-hook mechanism also being positioned in the housing and with a deflection member connected and further having a bridge plug attached for being releasably set in the well and a shifting port member connected to the tubular string and positioned in the housing.

FIG. 3*a* shows a side view of the shifting port member connected to the tubular string showing the port and the lug member for stabbing into the lateral well bore.

FIG. 6 shows a cross sectional side view of a housing member being run into a first wellbore casing with the orientation and positioning key driven outwardly into the window by the compressed spring between the housing and the orientation and positioning key and connected to the selective separating J-hook mechanism and a deflection member with the key having been pulled up hole toward the uphole apex of the window sill and the housing set against movement in the wellbore casing and the J-hook mechanism shifted and the tubing string and shifting port being lowered down hole into the deflection member for being deflected by the deflection member into a lateral well bore for re-entry and insertion into a stab-in.

FIG. 6*a* shows the shifting port as it is about to be stabbed into the stab-in, which is already located in the lateral well bore, by the tubular string shown in FIG. 6.

FIG. 6*b* shows the shifting port stabbed into the stab-in which is already located in the lateral well bore.

FIG. 6*c* shows the shifting port stabbed into the stab-in which is already located in the lateral well bore and the completion fluids, which in this case is cement, being pumped out of the port of the shifting port and through a port in the stab-in which the shifting port has shifted open for completion of the lateral well.

FIG. 6*d* shows the shifting port stabbed into the stab-in but released from the stab-in after the completion fluids have been fully pumped for completion of the lateral well.

FIG. 6*e* shows the shifting port in the process of being removed from the stab-in after completion of the lateral well.

FIG. 6*f* is the shifting port in the process of being returned to the housing by the tubular string to which it connected as shown in FIG. 6.

FIG. 12A—A shows a cross section through FIG. 12A.

FIG. 12B—B shows a cross section through FIG. 12B.

DESCRIPTION OF THE PREFERRED EMBODIMENTS

Figure 1A:
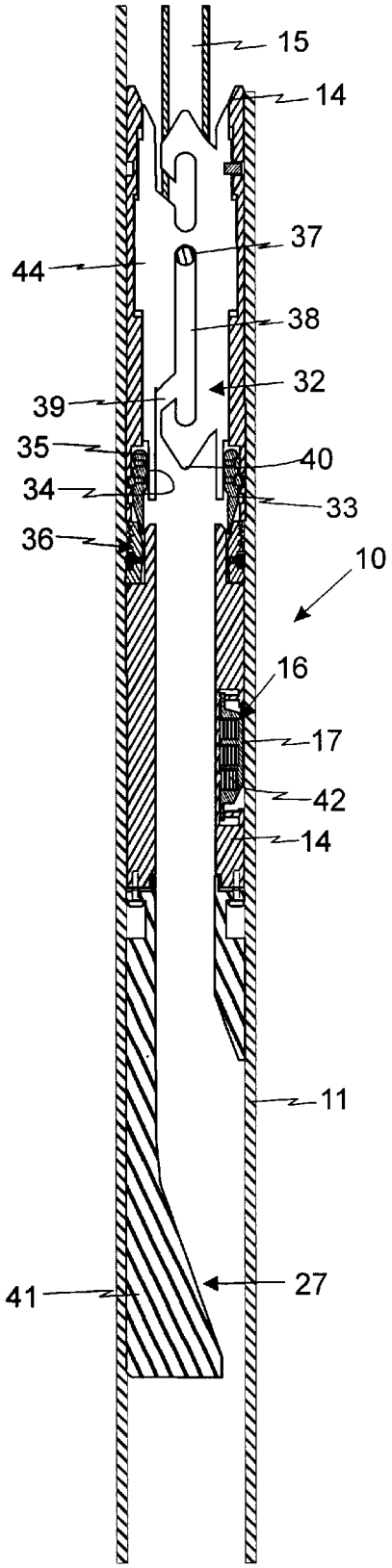
FIG. 1*a* is a cross sectional side view of a housing member being run into a first wellbore casing with the orientation and positioning key compressed against a spring and being located between the housing and the casing and the selective separating J-hook mechanism also being positioned in the housing and with a deflection member connected.

Referring now to the drawings of FIGS. 1*a, b, c,* & *d* wherein one embodiment of this invention is shown generally at reference number 10 having a first wellbore casing 11 with a window 12 formed in and through it and the window 12 being defined by a sill 13 in the first wellbore casing 11. It can be further seen that the housing member 14 is disposed in the first wellbore casing 11 for being run into the first wellbore casing 11 by a tubular string 15 which is connected to the housing member 14. Also seen in FIG. 1*a, b, c,* & *d* is the orientation and positioning member generally referred to at reference number 16 for orientation and positioning the housing member 14 relative to the window 12 defined by it's sill 13.

Figure 1B:
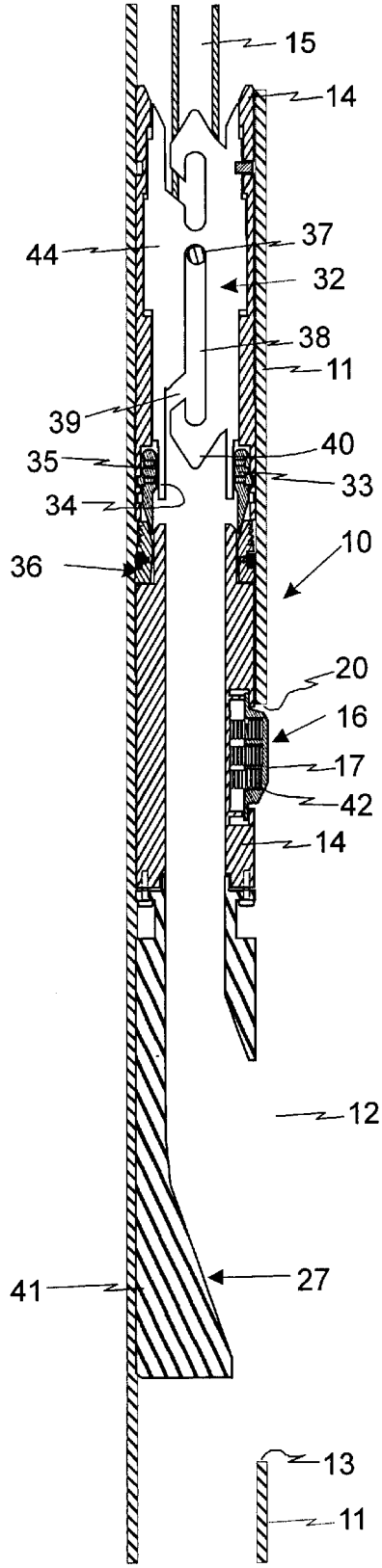
FIG. 1*b* is a cross sectional side view of a housing member being run into a first wellbore casing with the orientation and positioning key driven outwardly into the window by the compressed spring between the housing and the orientation and positioning key and the selective separating J-hook mechanism also being positioned in the housing and with a deflection member connected.

To better understand how the orientation and positioning member 16 functions, reference should be made to FIGS. 1*a* and 1*b,* which show that in this embodiment the orientation and positioning member 16 is composed of a key body 17, and a resilient springs 42 which are mounted between the housing member 14 and the key body 17 for driving the key body 17 outward from the housing member 14 upon the housing member 14 and the key body 17 passing over the opening of the window 12 in the first wellbore casing 11. For example in FIG. 1*a* the key body 17 is held compressed against the resilient springs 42 in the housing member 14 as the housing member 14 is lowered or run into the first wellbore casing 11. When it reaches the open window 12, which is defined by the sill 13 of the first wellbore casing 11, it is then driven outward from the housing member 14 into the opening of the window 12. As those skilled in the art will understand when tools are run into a wellbore they are both lowered and/or can be at the same time rotated. Thus when the key body 17 is driven into the window 12, it will strike the sill 13 because it is being rotated and it will come to a stop against the sill 13. This stopping of the key body 17 produces torquing forces on the tubular string 13 which is detected on the surface by the operator of the well, who then knows the key body 17 and housing member 14 have found the window 12 in the first wellbore casing 11. As lateral wellbores are drilled through windows the finding of the windows 12 would also mean in this case that window 12 would be positioned proximate at least a second wellbore 18 and also in communication with the window 12, through which the at least second wellbore 18 would have been drilled, as show in FIG. 4.

Figure 2A:
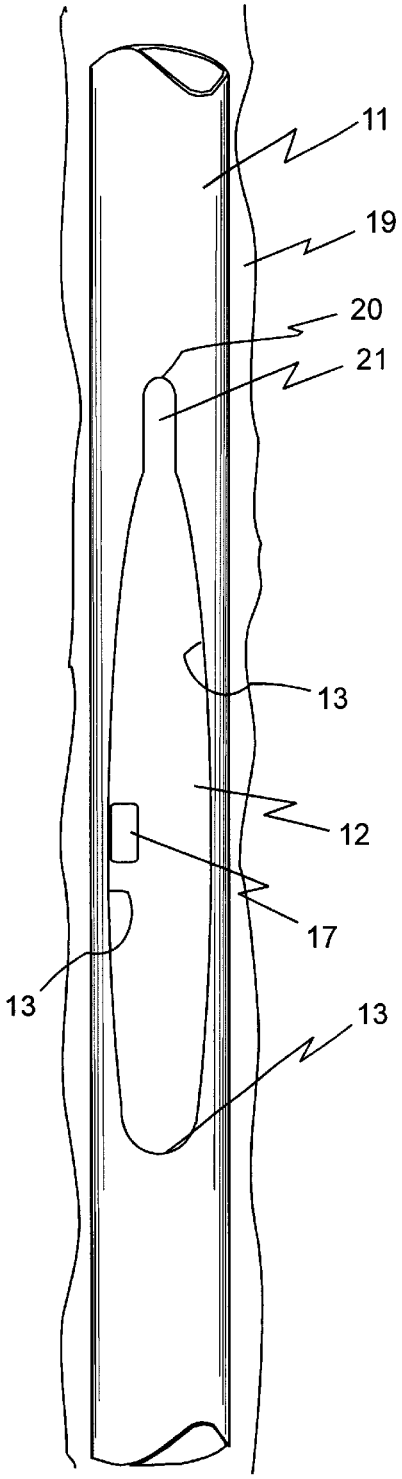
FIG. 2*a* is a side view of a section of the wellbore casing member with a downhole milled window formed in and through the wellbore casing member and showing the sill of the window for defining the window with an up hole apex member formed into a channel in the sill of the window and with an orientation and positioning member shown opened in the window and being prepared for up hole movement in the window.

The opening of the key body 17 in the window 12 can best be seen representatioinally in FIGS. 2*a, b, c, d, & e*. FIG. 2*a* shows a representational first well bore 19 with a section of the first wellbore casing 11 having a downhole milled window 12 with a sill 13 formed in the first wellbore casing 11 and the key body 17 projecting into the window 12 and stopped against the sill 13 of the window 12. As discussed above this produces torquing forces on the tubular string 13, which would tell the operator of the well that the window 12 has been found because the tubular string 15 would transmit torquing force up hole for a reading by the operator. Once the operator knows the housing member 14 is proximate the window 12 and the key body 17 is in the window 12, the next step in the operation of this invention for orientating and positioning this assembly is to pull substantially up hole on the housing member 14, which will cause key body 17 to ride or follow the sill 13 of the window 12 toward an up hole apex member 20. The up hole apex member 20 is formed by the sill 13 of window 12 being convergently curved up hole to the up hole apex of the sill 13 of the window 12. In the embodiment of FIG. 1*a* the up hole apex member 20 is formed into a channel member 21, which is in communication with the window 12 and is formed as part of the up hole apex member 20 for receiving the key body 17 as the key body 17 is moved uphole. It should be understood that the up hole apex member 20 would be located at substantially the highest point of the window 12 and substantially centered along the center line of the window running from the downhole portion of the window 12 and it's sill 13 to the up hole apex member 20.

It should be further understood that while the first wellbore casing 11 is indicated as vertical, in actuality it may be vertical, deviated or horizontal, and the lateral wellbore or lateral may or may not be horizontal. For the purposes of this disclosure, the terms are assigned to mean that the primary first wellbore casing 11 is considered to extend more up hole than the lateral, and is considered to be the main bore, and that the lateral is considered to be the secondary bore. There is nothing intended herein to designate either the main wellbore casing 11 or the at least second wellbore 18 as horizontal, deviated or vertical, but it should be understood that the primary wellbore casing is considered to be vertical or some degree thereof and the lateral is considered to be horizontal or some degree thereof. Further, the terms up hole or moving up hole mean moving in a direction which would eventually bring one to the surface of a well. The terms down hole or moving down hole means moving in a direction which would eventually bring one further into the earth even if at some point it might actually be moving "up hole" in the earth or horizontally, never the less it would be the direction opposite to moving toward the surface no matter whether it was physically up or down hole at any particular time in the process.

Figure 2B:
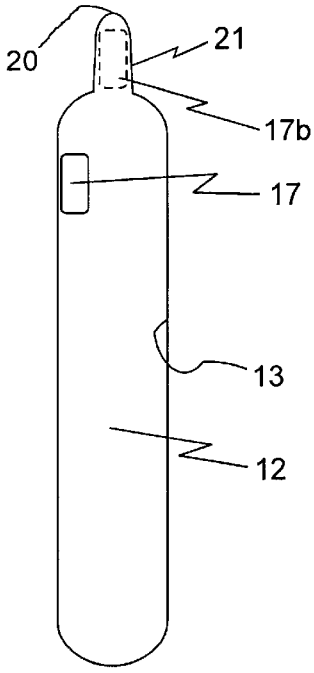
FIG. 2*b* is a representational side view of a premilled window formed in and through the wellbore casing and showing the sill of the window with an up hole apex member formed into a channel and shows the representational movement of an orientation and positioning member from being opened in the window to being moved to the channel member which is formed into the up hole apex of the sill of the window and it is shown in phantom lines at the up hole apex member.

The opening of the key body 17 into the window 12 for tracking along the sill 13 can be further seen in the remaining representational drawing of FIGS. 2*b, c, d, & e,* which just show the key body 17 in relation to the window 12 and it's sill 13 of the different type windows used in the drilling arts. Thus in FIG. 2*b* is shown a premilled window 12 having a sill 13, which is convergently curved up hole to an up hole apex member 20 and the up hole apex member 20 has been formed into a channel member 21 for receiving the key body 17 upon the housing 14 and key body 17 being moved up hole. This final position of the key body 17 in the channel member 21 is shown in phantom lines of the key body as 17*b*. It will also be seen that the channel member 21 is shown in communication with the window 12.

Figure 2C:
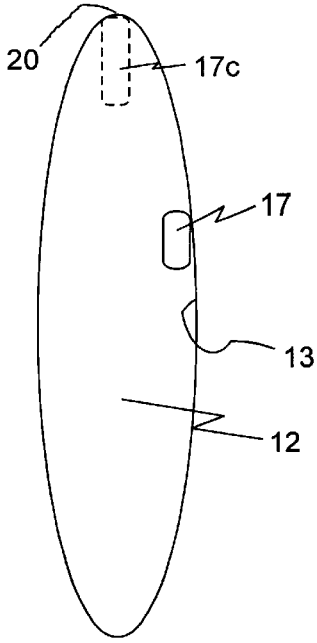
FIG. 2*c* is a representational side view of either a downhole milled or a premilled window formed in and through the wellbore casing and showing the sill of the window with an up hole apex member formed in the sill of the window and shows the representational movement of an orientation and positioning member being opened in the window and moved toward the up hole apex of the window and it is shown in phantom lines at the up hole apex member.

While in FIG. 2*c* is shown either a down hole milled window 12 or a premilled window 12 having a sill 13, which is convergently curved up hole to an up hole apex member 20 for receiving the key body 17 upon the housing 14 and key body 17 being moved up hole. The final position of the key body 17 in the up hole apex member 20 is shown with the key body 17 in phantom lines as 17*c*.

Figure 2D:
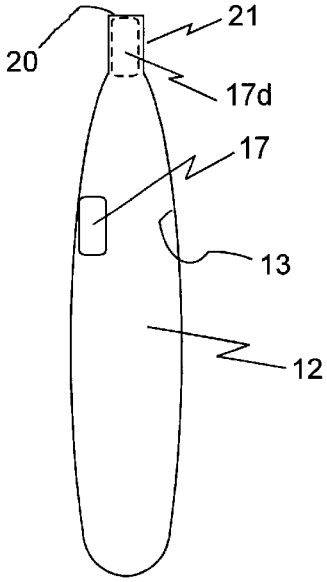
FIG. 2*d* is a representational side view of a downhole milled window formed in and through the wellbore casing and showing the sill of the window with an up hole apex member formed in the sill of the window and into a channel member and the representational movement of an orientation and positioning member from being opened in the window and to being moved toward the up hole apex of the window and it is shown in phantom lines at the up hole apex member.

In FIG. 2*d* is shown a down hole milled window 12 having a sill 13, which is convergently curved up hole to an up hole apex 20 and has been formed into a channel member 21 for receiving the key body 17 upon the housing 14 and key body 17 being moved up hole. The final position of the key body 17 in the up hole apex member 20 formed as a channel member 21 is shown with the key body 17 in phantom lines 17*d*. It will also be seen that the channel member 21 is shown in communication with the window 12.

Figure 2E:
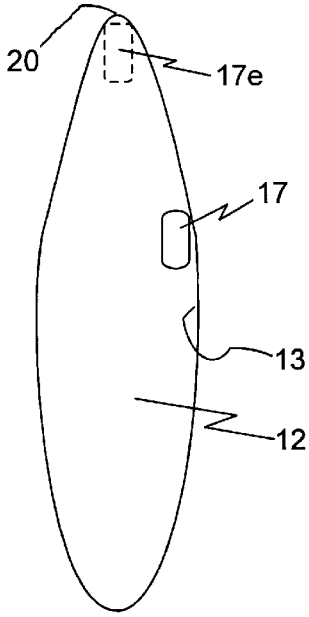
FIG. 2*e* is a representational side view of a downhole milled window formed in and through the wellbore casing and showing the sill of the window with an up hole apex member formed in the sill of the window and the representational movement of an orientation and positioning member from being opened in the window to being moved toward the up hole apex of the window and it is shown in phantom lines at the up hole apex member.

Still further in FIG. 2*e* is shown a down hole milled window 12 having a sill 13, which is convergently curved up hole to an up hole apex member 20 for receiving the key body 17 upon the housing 14 and key body 17 being moved up hole. The final position of the key body 17 in the up hole apex member 20 formed by the convergently up hole curving of the sill 13 of the window 12 to an up hole apex member 20 with the key body shown in phantom lines 17*e*.

It will be appreciated by those skilled in the art that in all the various types of windows either premilled or downhole milled that when the key body 17 is moved up hole and follows the sill 13 both the key body 17 and the housing member 14 will be orientated and positioned in relation to the window 12 and the second wellbore 18 when the key body 17 is moved up hole substantially toward and against the up hole apex member 20, which makes the assembly of this invention universally usable with many types of windows.

Figure 6:
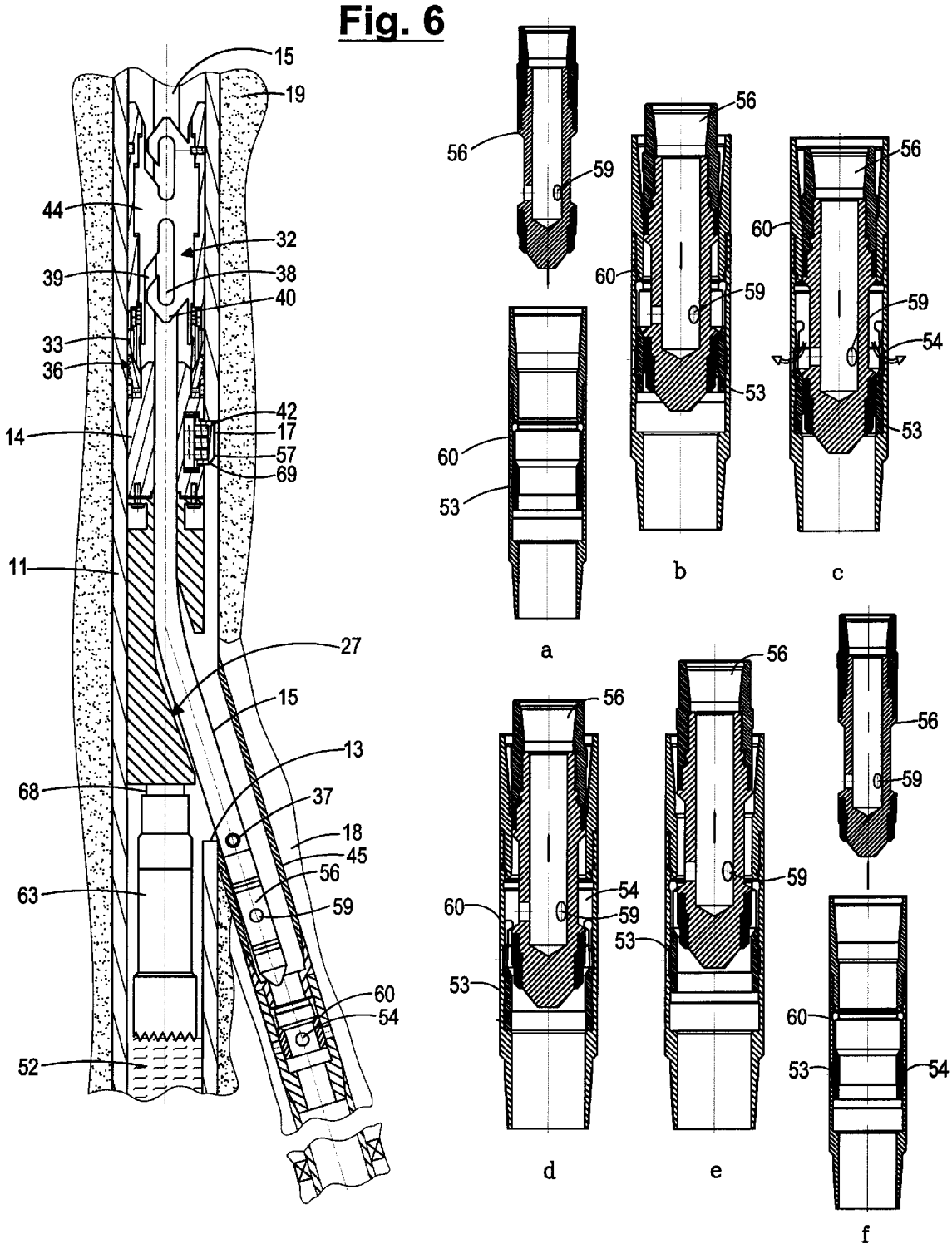

In the case where this assembly is used for completion, in lateral well bore without setting a permanent structure in the main well bore 11, the assembly might be configured as set in FIG. 3. In this case the assembly used for completion without setting a permanent structure in the main well bore 11 would use a bridge plug 46 which would be releasably connected to the housing member 14 by way of connection 68 to a deflection member 27. Also in this configuration would be releasably connected a shifting port 56 which can be sealable and has a port 59 and, which might be connected to the tubular string 15 as shown in FIGS. 6, 3, and FIG. 3A. Thus configured, in this case the assembly of this invention would be lowered down hole as the key body 17 is held compressed by the casing 11 against resilient springs 42 inside the housing 14 as shown in FIG. 3, until the key body 17 reaches the window 12. Once the key body 17 reaches the window 12 it would be driven out ward and strike the sill 13 of the window 12. Once the operator has an indication that the key body 17 has struck the sill 13 of the window 12, the operator would pull up hole on the tubular string 15 and the key body 17 would be moved up hole to the up hole apex member 20 and held against the up hole apex member 20 by keeping up hole pressure on the tubing string 15, which also holds the housing member 14 in place as would be seen in FIG. 4 to identify the exact location of the window 12 on the surface. At this point there are at least two paths of operation for the completion equipment of this configuration of the invention.

If the one path desired is to set the bridge plug 46, in this configuration, then the operator would let down on the tubular string 15 until the down hole side 69 of the key body 17 would strike the down hole sill 13 of the window 12. It should be noted that the down hole side 69 of the key body 17 has a sloped surface 57 for driving the key body 17 against resilient springs 42 inside the housing 14, so that once again the key body 17 would be driven back into the housing member 14, which would allow the housing and assembly to move down hole past the window 12 a desired distance for the setting of the releasable bridge plug 46. The bridge plug 46 would be set and if desired a "liquid pill" 52 would be set on top of the bridge plug 46 for the protection of the bridge plug 46 and for making the bridge plug 46 easier to retrieve.

Figure 4:
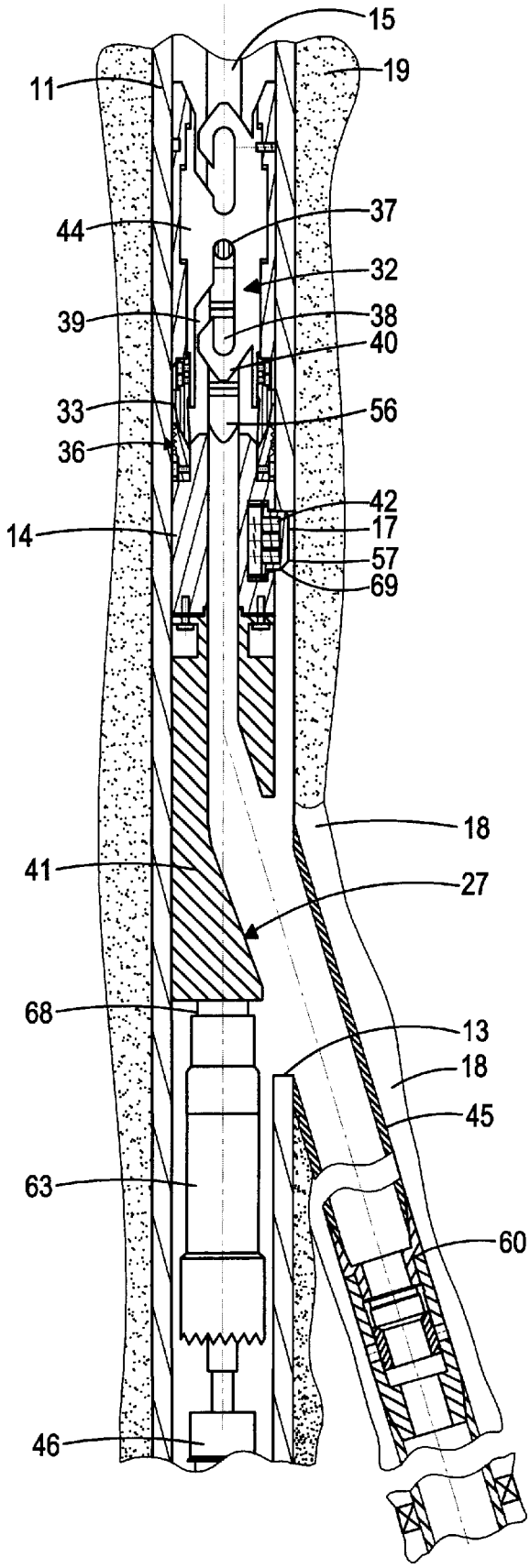
FIG. 4 shows a cross sectional side view of a housing member being run into a first wellbore casing with the orientation and positioning key driven outwardly into the window by the compressed spring between the housing and the orientation and positioning key and the selective separating J-hook mechanism also being positioned in the housing and with a deflection member connected and further having a bridge plug attached for being releasably set in the well and a shifting port member connected to the tubular string and positioned in the housing.
Figure 5:
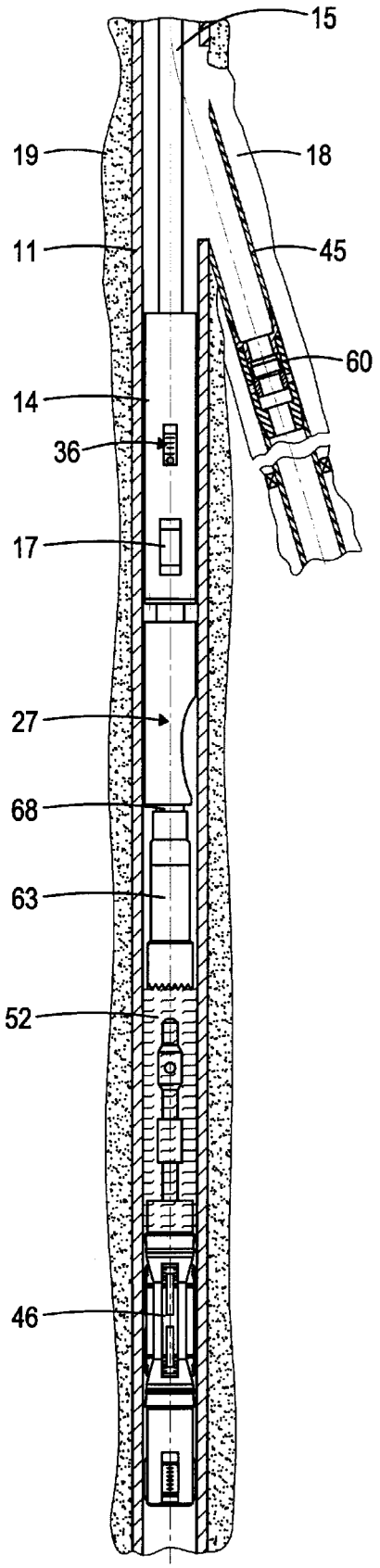
FIG. 5 shows a cross sectional side view of a housing member being run past the window into a first wellbore casing with the orientation and positioning key again compressed against a spring between the housing and the orientation and positioning key and the selective separating J-hook mechanism also being positioned in the housing and with a deflection member connected and a shifting port member connected to the tubular string and positioned in the housing but the bridge plug de-attached and set in the well, with a fluid cushion deposited on the bridge plug.
Figure 7:
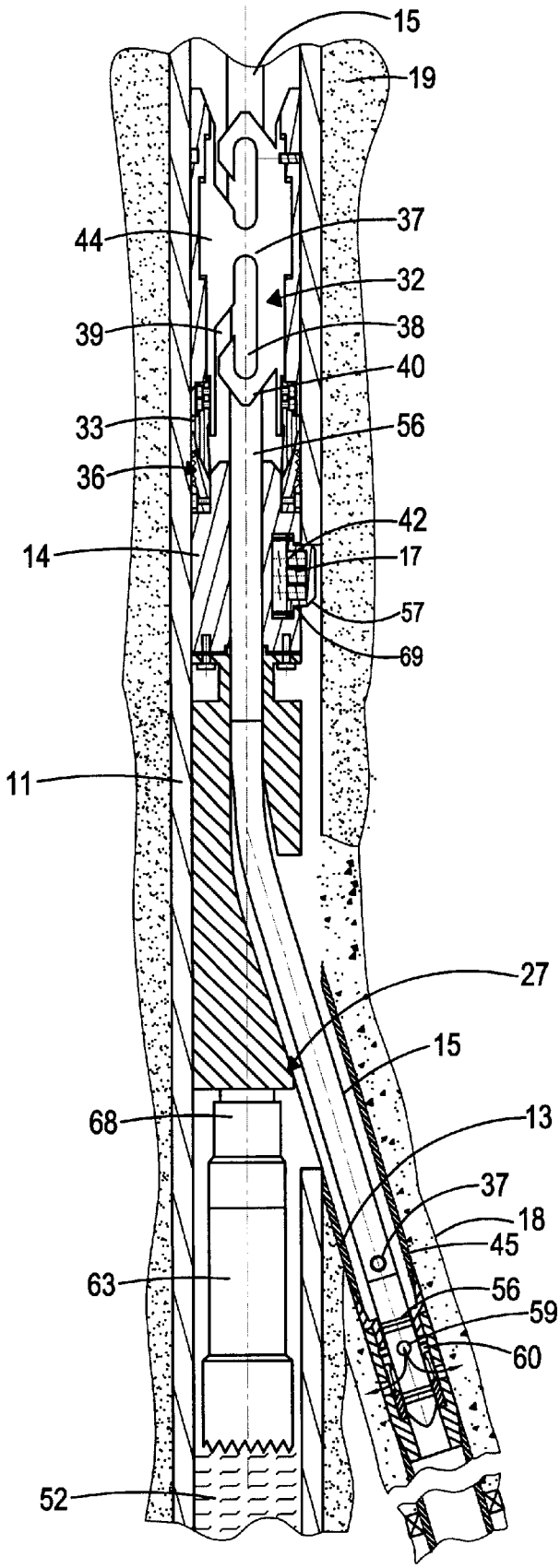
FIG. 7 is a cross sectional side view of a housing member being run into a first wellbore casing with the orientation and positioning key driven outwardly into the window by the compressed spring between the housing and the orientation and positioning key and the selective separating J-hook mechanism also positioned in the housing and with a deflection member connected with the key having been pulled up hole toward the uphole apex of the window sill and the housing set against movement in the wellbore casing and the J-hook mechanism has been shifted and the tubing string and shifting port being lowered down hole into the deflection member for being deflected by the deflection member into a lateral well bore and stabbed into the stab-in and the completion fluid being injected into the lateral well bore for completion, which in this case is cement.
Figure 8:
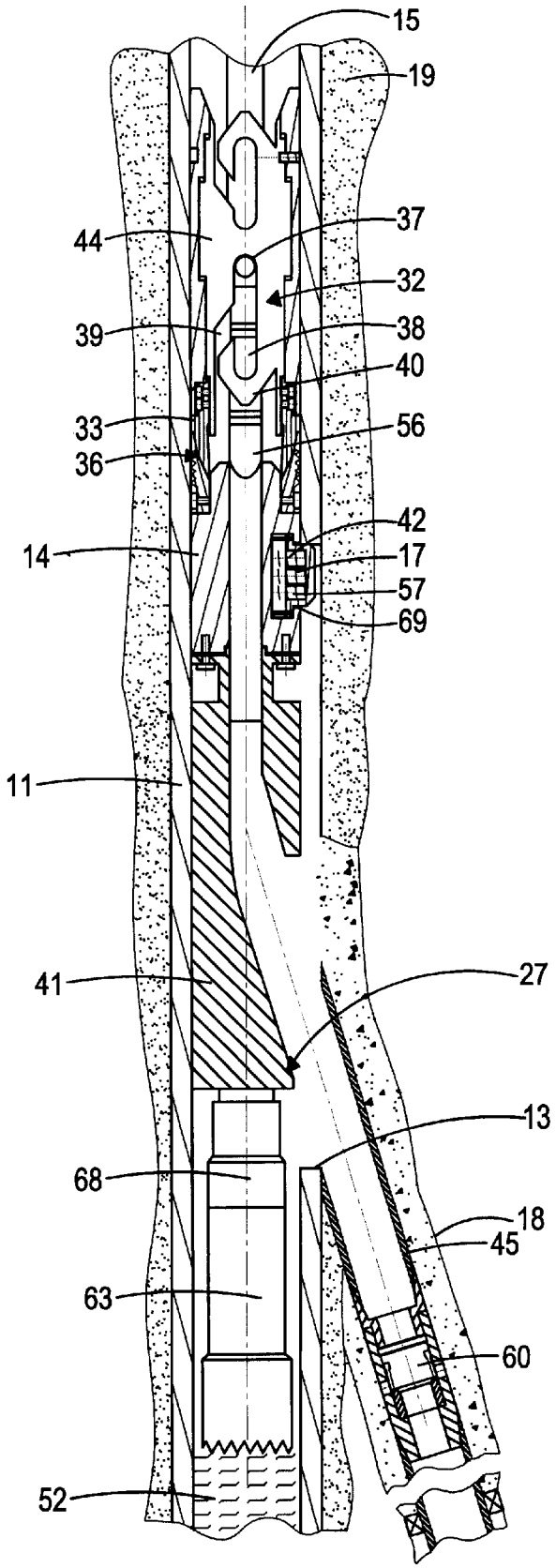
FIG. 8 is a cross sectional side view of a housing member being run into a first wellbore casing with the orientation and positioning key driven outwardly into the window by the compressed spring between the housing and the orientation and positioning key and the selective separating J-hook mechanism also positioned in the housing and with a deflection member connected with the key having been pulled up hole toward the uphole apex of the window sill but the housing has been un-set for movement in the wellbore casing and the tubing string and shifting port being secured in the housing for up or downhole movement.

Once the operator has the bridge plug 46 and the "liquid pill" 52 set, the operator would again pull up hole and rotate, as shown in FIG. 5, until the key body 17 reaches the window 12 and is driven outward into the window 12. By the operator continuing to pull up hole the key body 17 would follow the sill 13 into position in the uphole apex member 20 and come to rest in the proper orientation and position, as shown in FIG. 4, for the steps for the completion of the lateral well bore casing 45. While continuing to pull up hole, which holds the assembly 10 in orientation and position, the operator would activate the selective separating mechanism 32 located in the housing member 14 by the rotation of the tubular string 15. The operator would continue rotation and until the housing member 14 is releasably set in the main wellbore casing 11 by the slip grabbing members 36. A more detailed description of the selective separating mechanism 32 will be discussed later. However upon the separation of the tubular string 15 and the shifting port 56 which is attached to the tubular string 15, the operator may let down the tubular string 15 and the shifting port 56 into the deflection member 27 for being deflected into the lateral wellbore casing 45, as show in FIG. 6. By continuing to let down on the tubular string 15 and the shifting port 56, they will be driven into the lateral wellbore casing 45 and into a stab-in member 60 as best shown in FIG. 6 and FIG. 7. Once the shifting port 56 is inserted into the stab in 60 a sleeve 53 located in the stab in 60 is moved downward to open a port 54 through which completion fluids, such as cement may be pumped, as shown in FIG. 6 *a, b,* and *c*. The operator then commences pumping completion fluid, such as cement, into the well for the completion of the lateral well bore casing 45, as shown in Fig. 7. After the completion the shifting port 56 is disengaged from the stab-in member 60 and its sleeve 53 and retracted up hole by the operator back into the housing member 14 and secured, as would best be seen in FIG. 8.

As those skilled in the art will appreciate some times some of the cement may be washed over into the first well bore casing 11 and it is desirable to remove that material, but with out affecting the freshly cemented and completed lateral well bore 18 with the second lateral wellbore casing 45 therein and the junction formed at the interface of the main well bore casing 11 and the second wellbore 18. In such case, then the operator can make up the assembly of this invention with a sleeve member 48 mounted on the housing member 14, as shown in FIG. 9B. In this configuration the operator would let down again on the tubular string 15 and drive the key body 17 again back into the housing member 14, and lower the housing member 14 sufficiently to have the sleeve member 48 cover the window 12 and seal off the outside of the sleeve member 48, with at least one seal 61 or even a second seal 58. Once this sealing of the window 12 at the junction of the main well bore casing 11 and the second wellbore 18 has occurred, then the operator may circulate fluids through the tubular string 15, and out the port 59 of shifting port 56 to flush the cement or other debris and the liquid pill 52 up and through apertures 62 and up and out of the first wellbore casing 11 by passing them through the sleeve member 48. After the flushing operation has occurred, then the operator may let down further on the tubular string 15 and the housing member 14, until the retrieving member 63 engages the bridge plug 46 for removal. The operator may then pull the whole assembly out of the first wellbore casing 11 and leave a clean and clear completed lateral wellbore casing 45 at the junction of the interface between the first wellbore casing 11 and the second wellbore 18 without any whip stocks or any other obstructions left in the first wellbore casing 11.

Figure 9A:
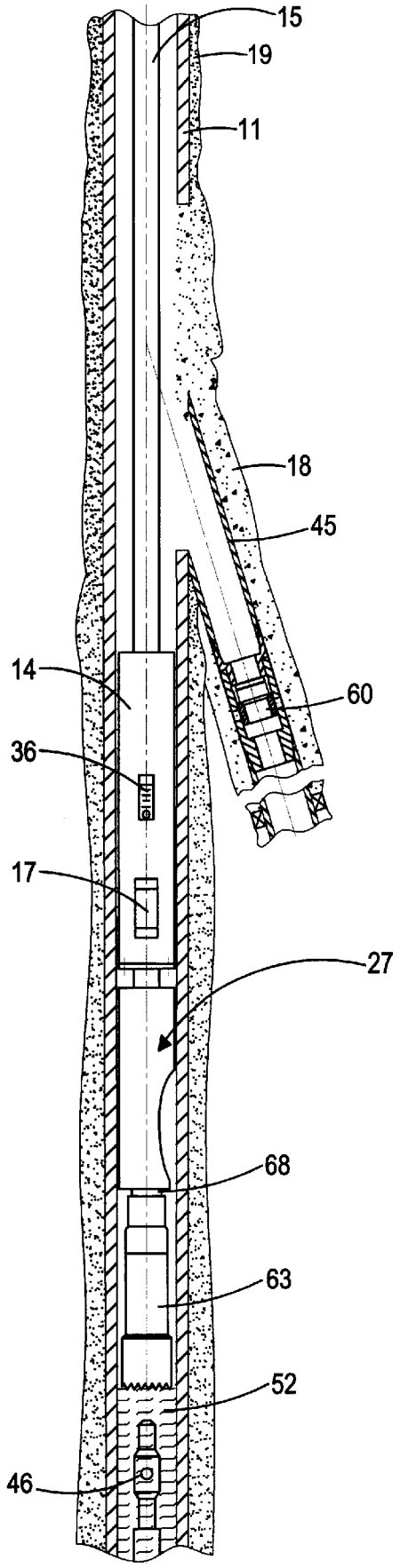
FIG. 9A shows a cross sectional side view of a housing member being run into a first wellbore casing with the orientation and positioning key driven back on to the compressed spring and between the housing and the first wellbore casing and the selective separating J-hook mechanism also being positioned in the housing and the deflection member and the housing being lowered down hole toward the bridge plug but stopped sufficiently down hole from the window to allow circulation of fluids to remove the liquid pill up hole.
Figure 9B:
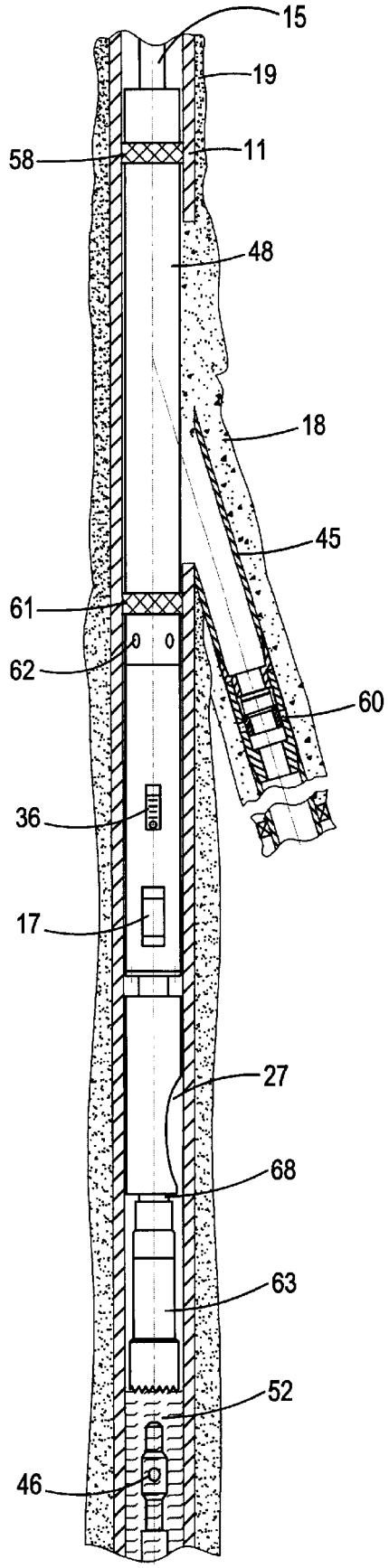
FIG. 9B shows a cross sectional side view of a housing member being run into a first wellbore casing with the orientation and positioning key driven back on to the compressed spring and between the housing and the first wellbore casing and the selective separating J-hook mechanism also being positioned in the housing and the deflection member and the housing being lowered down hole toward the bridge plug but stopped sufficiently down hole from the window to allow the sleeve to cover the window and for allowing circulation of fluids to remove the liquid pill up hole through the apertures on the sleeve.
Figure 10:
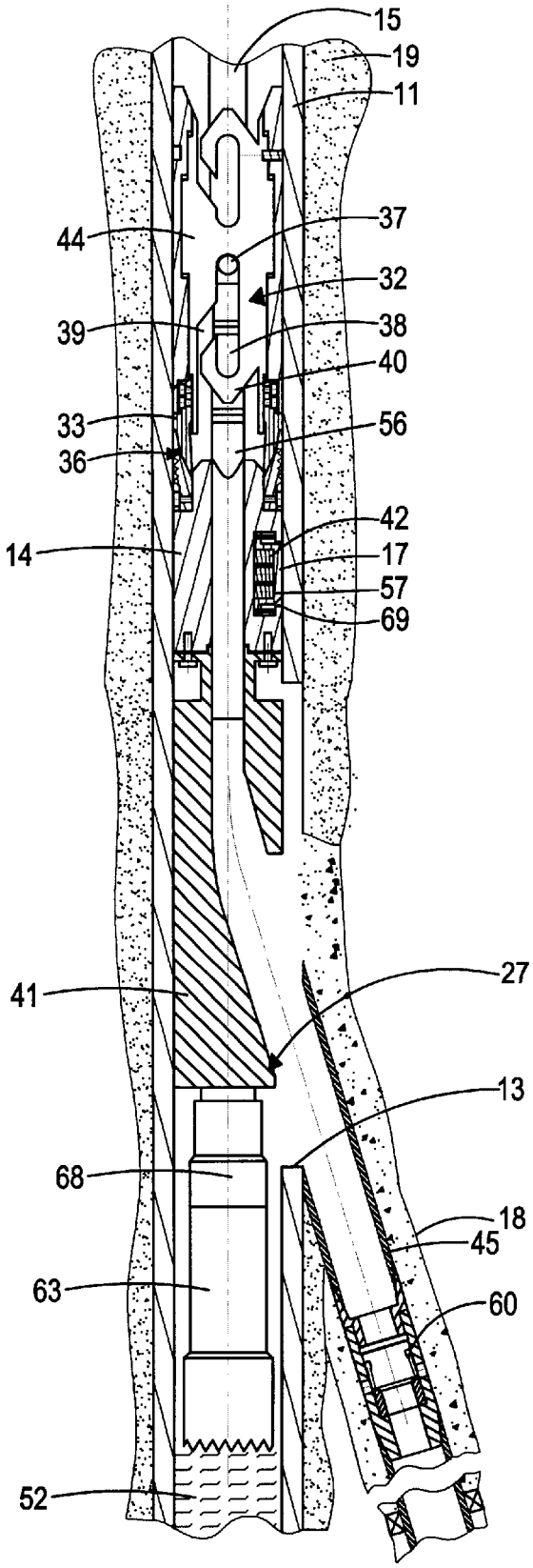
FIG. 10 shows a cross sectional side view of a housing member being run out of a first wellbore casing with the orientation and positioning key compressed against a spring and being located between the housing and the first wellbore casing and the selective separating J-hook mechanism and a deflection member and further having re-attached the bridge plug to the housing for releasable removal from the well and the shifting port member reconnected to the tubular string and positioned in the housing.

In both configurations of FIG. 9B with or FIG. 9A without a sleeve member 48 the bridge plug 46 may be removed without having to run an additional trip back into the well, which provides for great efficiency of time and expense by using this invention.

Figure 14:
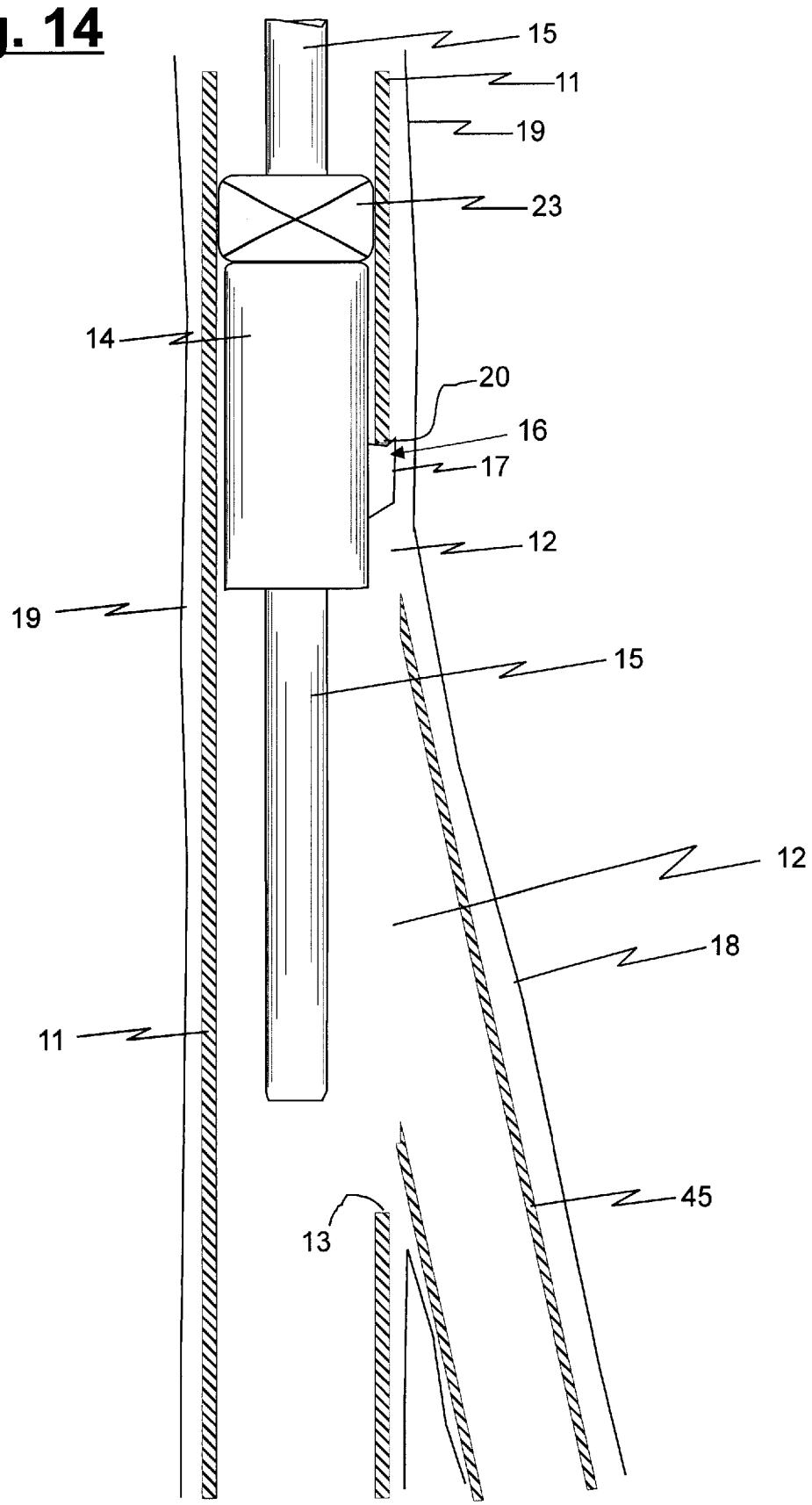
FIG. 14 shows this invention in partial side cross sectional view configured for a simple completion with a single packer assembly for the main well bore casing proximate the junction of one lateral well bore.

In other cases where this assembly is used for different types of completions the assembly can be made up in different configurations, but the assembly of this invention would require the key body 17 to be used and held against the uphole apex member 20 by keeping up hole pressure on the tubular string 15, which also holds the housing member 14 in place properly positioned and orientated. Simultaneously while the tubular string 15 is keeping uphole pressure on the key body 17 and housing member 14, a first completion packer 23 can be set in the main well bore casing 11, as shown in FIG. 14. In some embodiments that may be done hydraulically or in any other way, even by for example the tubular string 15 can be rotated to actuate the setting of a first completion packer 23. However this setting of first completion packer 23 is done, those skilled in the art will appreciate the benefit, that while it is being set in place and held in position, it is being held by tension between the surface and the point where the key body 17 and the up hole apex member 20 meet. Thus on floating platforms with much movement the location and position of the first completion packer 23 is held in substantially a constant position and unaffected by the wave action on the surface. It is also true, as those skilled in the art will appreciate, that the setting under tension eliminates the error which can be caused by the spring effect of the tubular string 15 in setting a first completion packer 23 in a very deep first wellbore casing 11.

Figure 15:
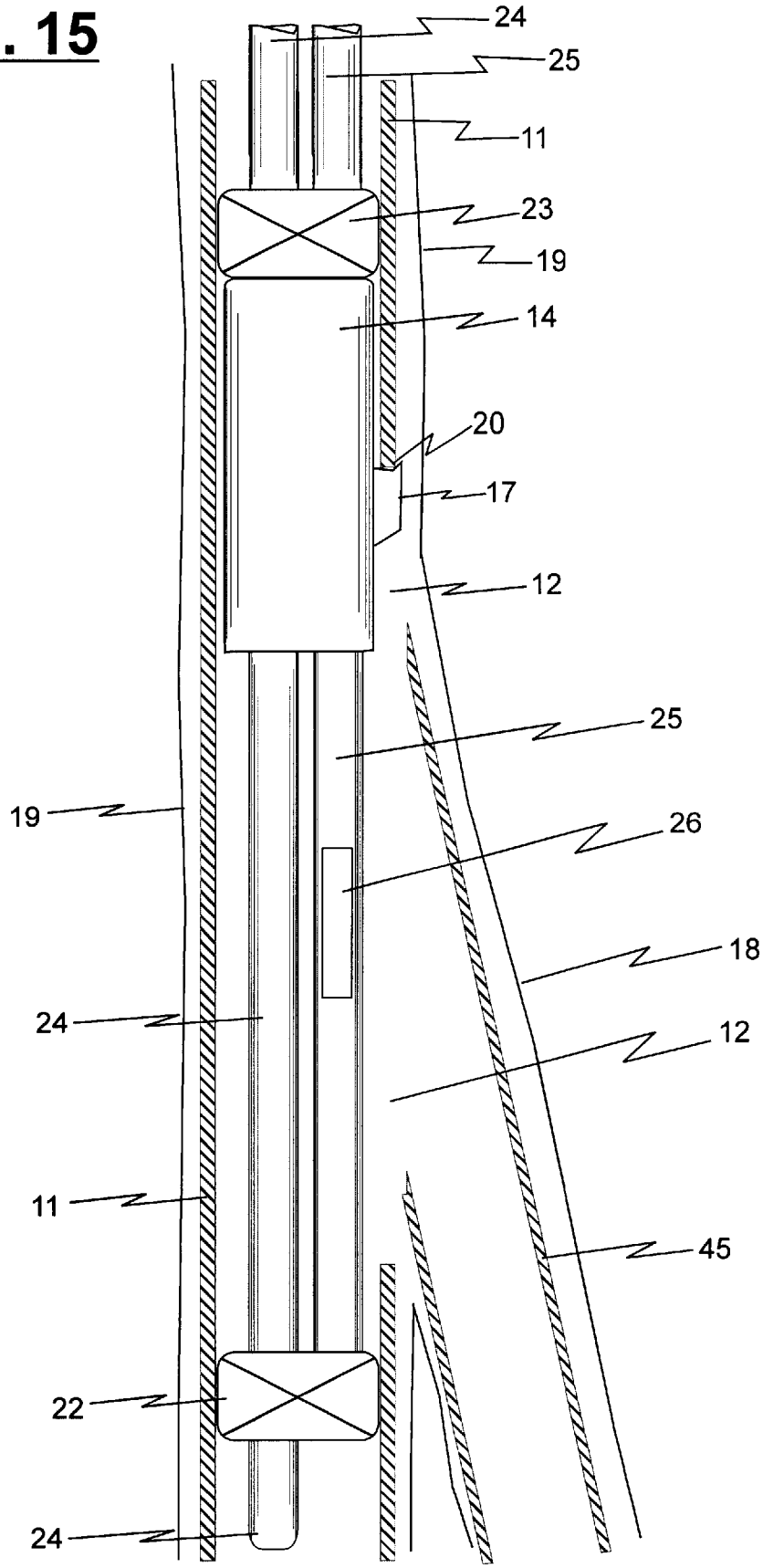
FIG. 15 shows this invention in partial side cross section view configured for a simple completion with a single packer assembly for the main well bore casing proximate the junction of one lateral well bore at their junction and using a second packer and production opening for selectively producing the at least one lateral well bore at the junction of the at least one lateral well bore and main well bore casing.

In yet other applications of this invention as shown in FIG. 15 a second completion packer 22 can be connected to the tubular string 15 with the first completion packer 23 for being run into the first wellbore casing 11. This configuration would allow the formation of a completion in the first wellbore casing 11 both above and below the junction of the second well bore 18. In a completion of this type the first wellbore 19 and the second wellbore 18 fluids would be isolated from each other should they be present. In FIG. 15 is also shown a first production tubing 24 which was made up with the first completion packer 23 and the second completion packer 22, which allows zones of hydrocarbon to be produced below the window 12 without interfering with the production from the second well bore 18 after the first and second completion packer 22 or 23 are set. As those skilled in the art will appreciate the second production tubing 25 that is to produce the second wellbore 18 would have an opening 26 in it as shown in FIG. 15 to allow the production of the second wellbore 18. In the process of setting these completion members, first completion packer 23 and second completion packer 22, the essential elements are finding, and orientating, and then positioning them relative to the window 12 and the second wellbore 18. Thus with this invention it is possible to find, orient and position these completion members relative to the second wellbore 18 in many window types. Also from FIG. 15 it can be seen that without key body 17 which located the window 12 and orientated and positioned the first and second completion packers 22 and 23 there would be no way to find the window 12, because the wellbore casing 11 would look like any plain wellbore in the first wellbore casing 11, fully open and without any projections into the internal diameter of the first wellbore casing 11. Thus, it should be appreciated that the assemblies and methods of this invention provide a universal application to all wellbores with a window and, without special configurations being necessary downhole at or near the window in the first wellbore casing 11, ie. just wellbores like those shown in FIG. 18*a* & *b* can be used.

Figure 16:
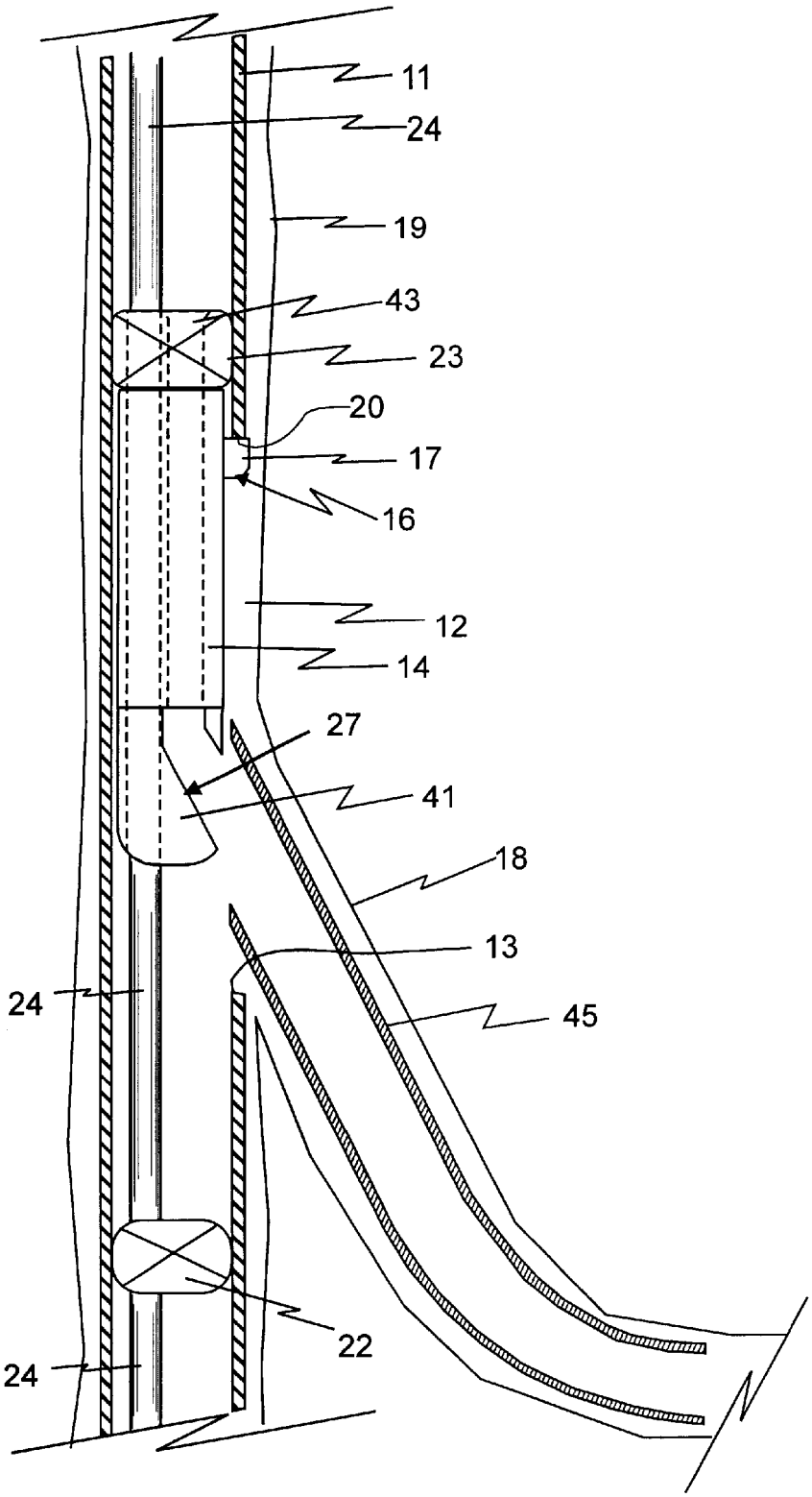
FIG. 16 shows this invention in partial side cross section view configured for a simple completion with a packer assembly for the main well bore casing and at least one lateral well bore at their junction and using a second packer in the main wellbore casing and with a work string having been run into the at least one lateral well bore to set a production liner for producing the at least one lateral well bore at the junction of the at least one lateral well bore and main well bore casing and having a deflection member connected to the housing for allowing reentry into the at least one lateral wellbore at a later time.
Figure 17:
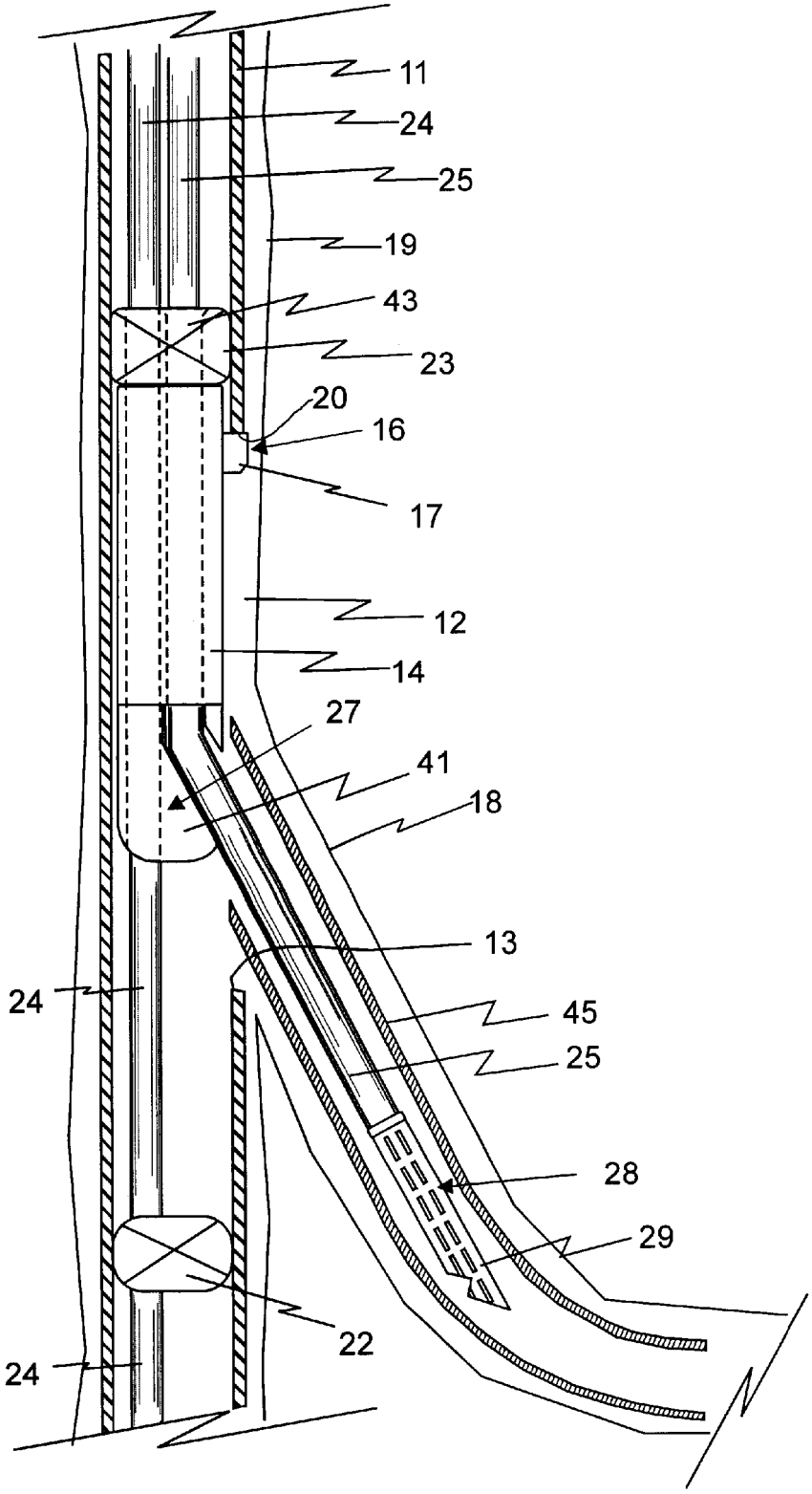
FIG. 17 shows this invention in partial side cross section and configured for a completion with a single packer assembly for the main well bore casing and at least one lateral well bore at their junction and using a second packer in the main wellbore casing, and with a tubing string having run a production liner into the at least one lateral well bore liner for producing the at least one lateral well bore at the junction of the at least one lateral well bore and main well bore casing and having a deflector member connected to the housing and an additional tubular string, having been deflected, being run into the lateral well and connected with the production liner in the at least one lateral well bore.

In yet other make ups of the assembly of this invention as shown in FIGS. 16 & 17 the first completion packer 23 and second completion packer 22 can be made up with a deflection member 27, such as a whipstock 41, positioned in between to allow reentry in the second wellbore 18. In the make up of this configuration that part of the first production tubing 24 which passes through the junction of the second wellbore 18 and the first wellbore casing 11 and is between the first completion packer 23 and second completion packer 22 would have a housing 14 positioned relative the window 12 to allow the deflection of a second production tubing string 25, not shown in FIG. 16, but shown in FIG. 17 to reenter through the first completion packer 23 and be deflected into the second wellbore 18 and any lateral wellbore casing 45 which may be present. Thus the assembly of this invention allows selective reentry of second wellbore 18 even when the first wellbore casing 11 is fully completed, because the orientation and positioning member 16 allows the proper orientation and positioning of the deflection member 27 at the same time it is positioning the first completion packer 23, and second completion packer 22 for completion.

Figure 18A:
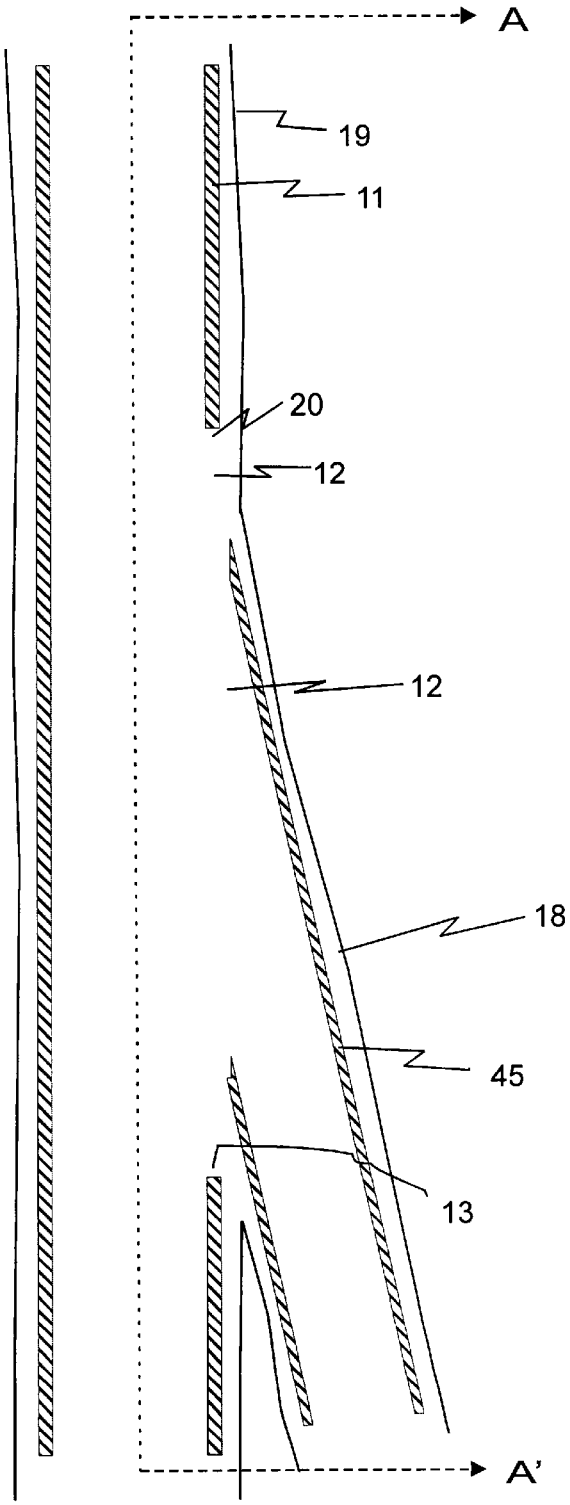
FIG. 18*a* is a partial side cross section and representational view of a main wellbore casing and the window and the window sill with the at least second wellbore being proximate to the main wellbore casing in a representational condition of an existing well which might be desired for reentry and showing no projections into the main well bore casing to assist for reentry.
Figure 18B:
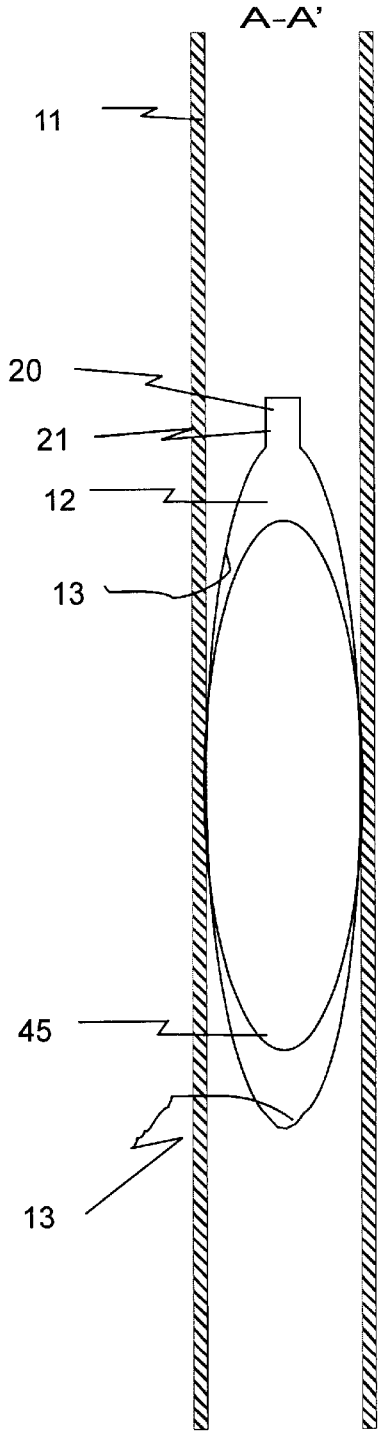
FIG. 18*b* is a partial front cross section and representational view taken through A—A of FIG. 8*a* of the main wellbore casing and the window and the window sill with the at least second wellbore being proximate to the main wellbore casing in a representational condition of an existing well which might be desired for reentry and showing no projections into the main well bore casing to assist for reentry.
Figure 19:
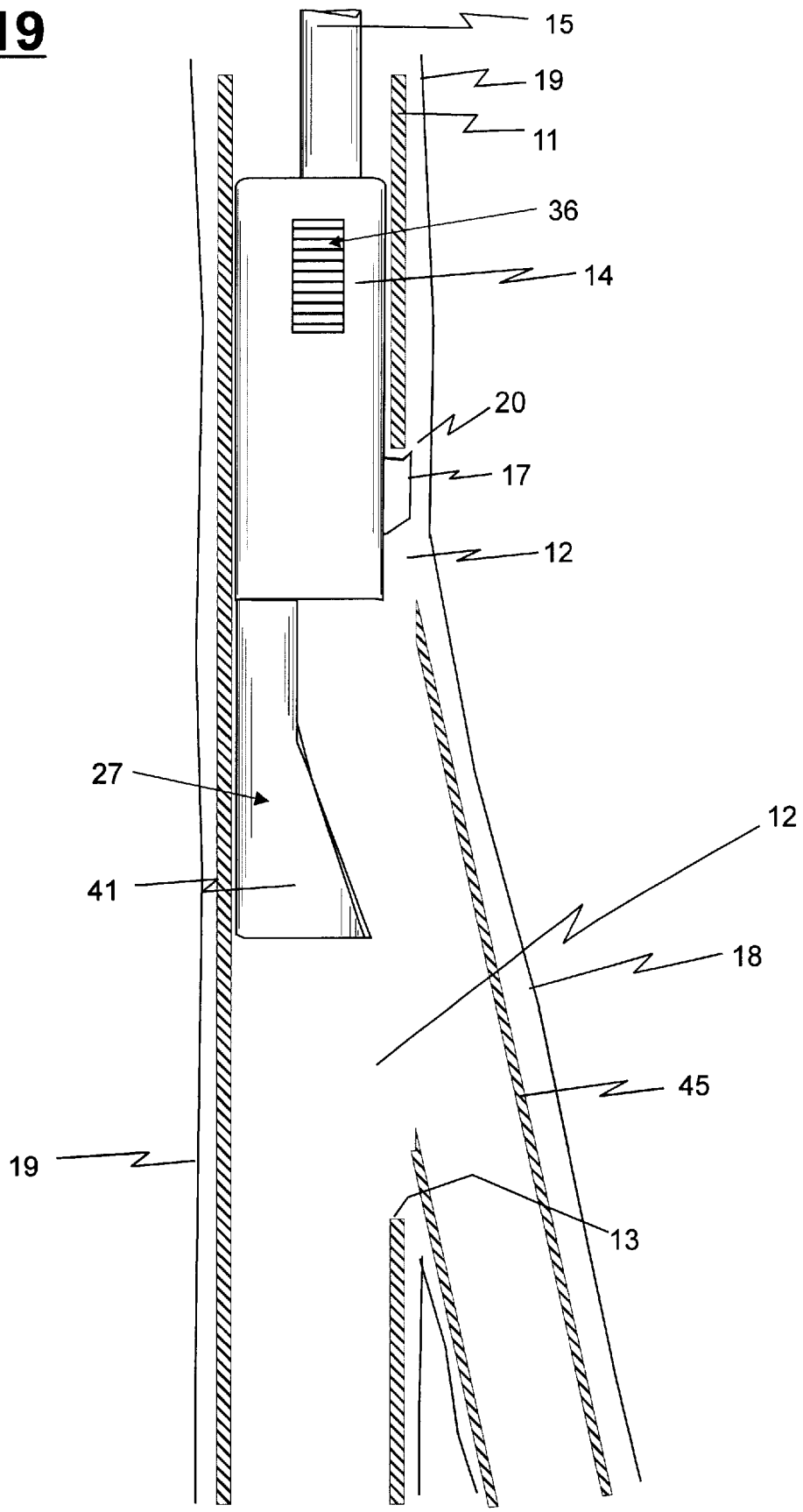
FIG. 19 shows a partial side cross section view of a main wellbore casing and the window and the window sill with the at least second wellbore being proximate to the main wellbore casing in a representation condition of an existing well with the housing positioned and oriented in the window and the key member pulled substantially up hole toward the up hole apex member for setting the housing with the slip grabbing members set to prevent movement of the housing and with a deflection member, which in this case is a whipstock, for driving a tubular string into the at least one lateral well for reentry.
Figure 20:
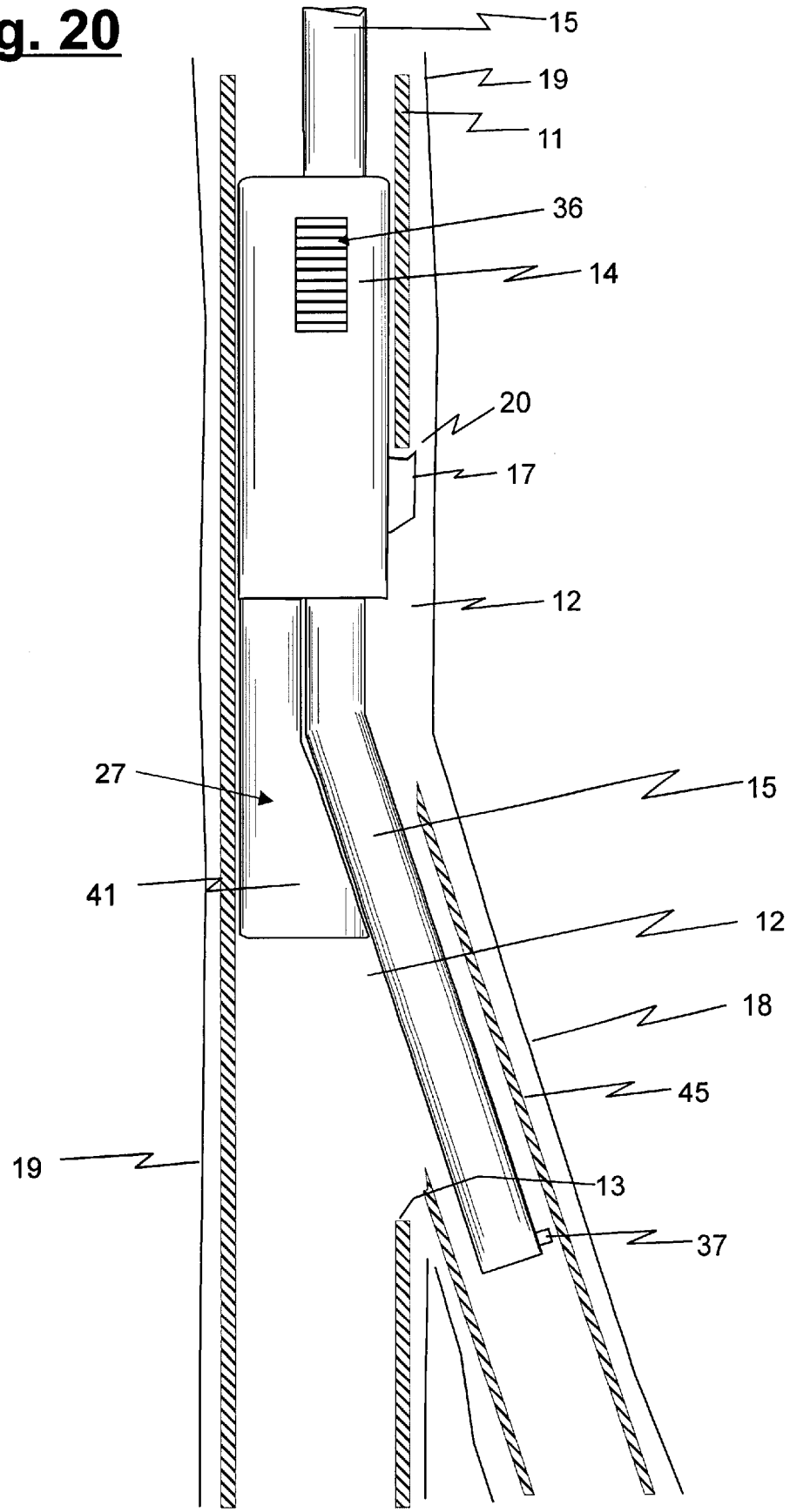
FIG. 20 shows a partial side cross section of a main wellbore casing and the window and the window sill with the at least second wellbore being proximate to the main wellbore casing in a representational condition of an existing well with the housing positioned and oriented in the window and the key member pulled substantially up hole toward the up hole apex member for setting the housing with the slip grabbing member set to prevent movement of the housing and with a whipstock for driving a tubular string into the at least one lateral well for reentry with the tubular string shown in the process of reentering the at least one lateral well bore, after having been deflected by the whip stock.

In further applications of this invention as shown in FIG. 19 reentry into the second wellbore 18 and any lateral wellbore casing 45, which may be present, is achieved even in a smooth first wellbore casing 11, as shown in FIG. 18*a* & *b,* with no internal projections or packers for orientation being necessary by the invention of this assembly. Thus in this embodiment of the invention, reentry is readily achieved by a reentry member referred to at the general reference 28, which may take the form as shown in FIG. 17, of a production liner 29, or any other member for movement into the second wellbore 18. The reentry of these reentry members 28 is achieved as they are deflected into the second wellbore 18 by an attached deflector member 27, which may be a whip stock 41, connected to the housing member 14 with fasteners 49. This deflection member 27 is attached at such a position to deflect the reentry member 28 connected to tubular string 15 into the second wellbore 18 as said tubular string 15 is selectively separated from the housing member 14 and advanced downward into the deflector member 27.

Figure 1C:
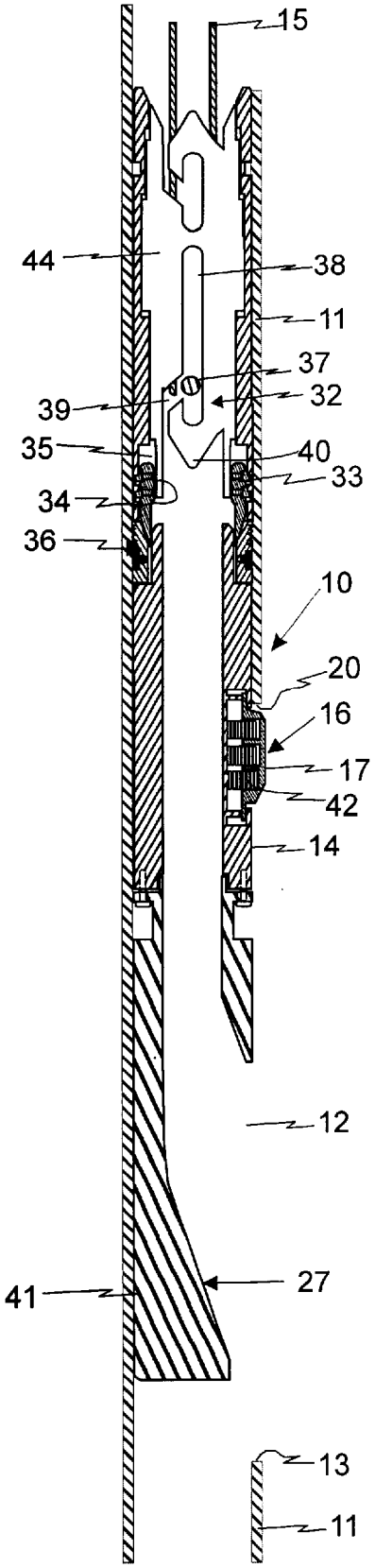
FIG. 1*c* is a cross sectional side view of a housing member being run into a first wellbore casing with the orientation and positioning key driven outwardly into the window by the compressed spring between the housing and the orientation and positioning key and the sleeve separating J-hook mechanism also being positioned in the housing and a deflection member connected with the orientation and positioning key having been pulled up hole toward the uphole apex of the window sill and the housing set against movement in the wellbore casing and the J-hook mechanism shifted to begin the separation of the tubular string from the housing for reentry into a lateral well.
Figure 1D:
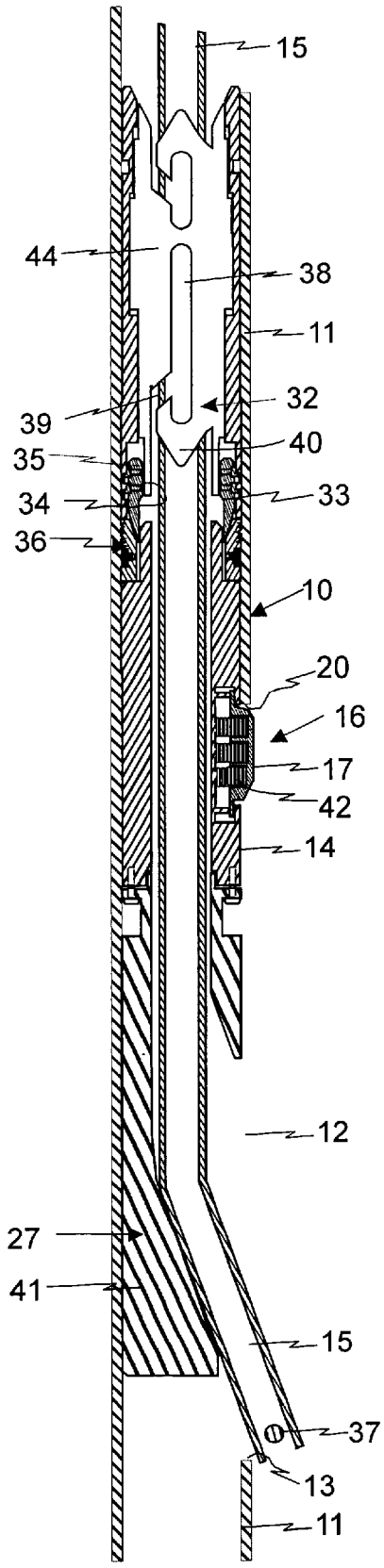
FIG. 1*d* is a cross sectional side view of a housing member being run into a first wellbore casing with the orientation and positioning key driven outwardly into the window by the compressed spring between the housing and the orientation and positioning key and the selective separating J-hook mechanism also being positioned in the housing and a deflection member connected with the key having been pulled up hole toward the uphole apex of the window sill and the housing set against movement in the wellbore casing and the J-hook mechanism shifted and a tubing string being lowered down hole into the deflection member for being deflected by the deflection member into a lateral well bore for reentry.
Figure 11:
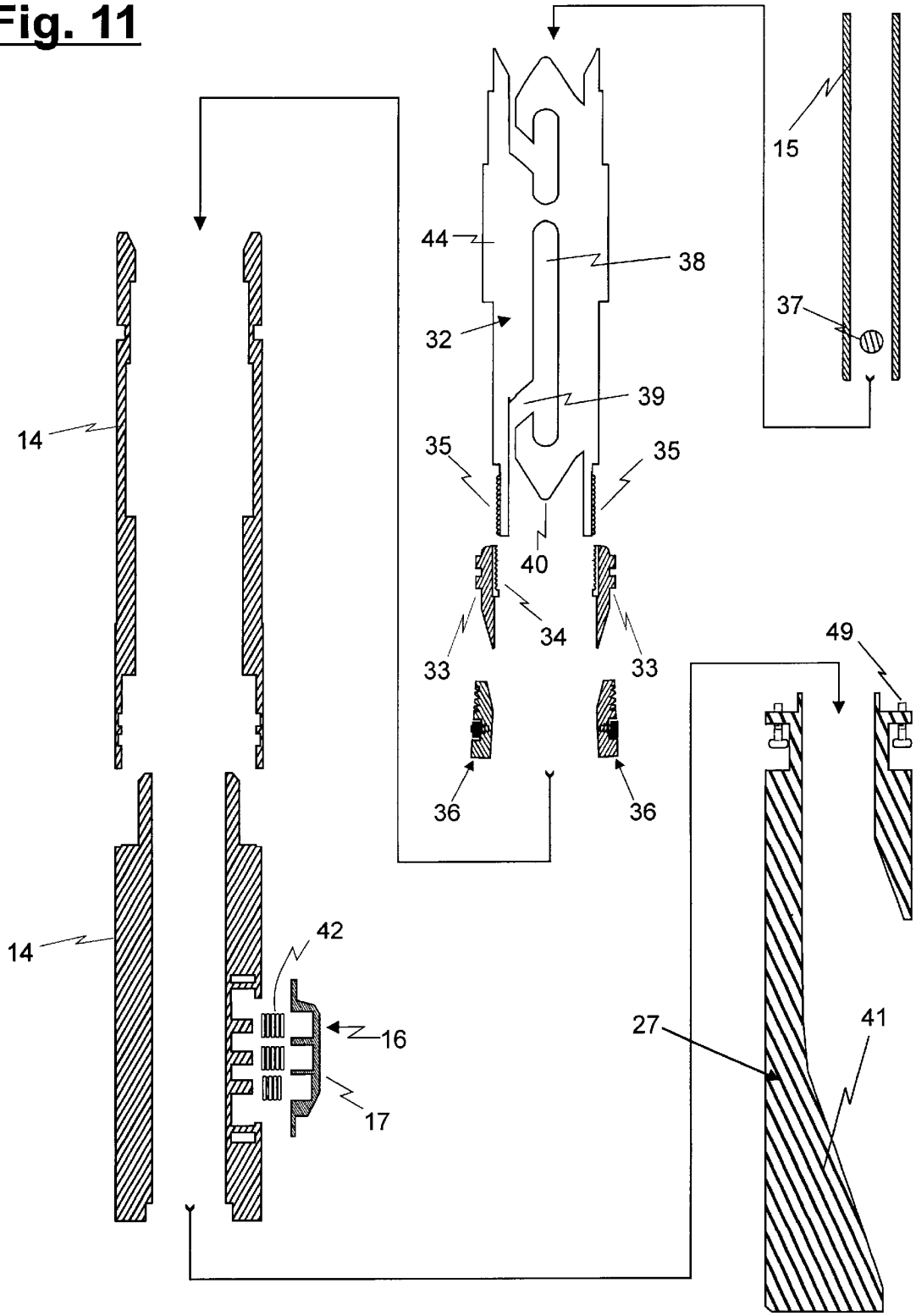
FIG. 11 shows an exploded and cross sectional view of the housing member, key member, resilient spring, deflection member, setting mechanism for the housing member and the selective releasing mechanism of the J-hook.

To better see the selective separating mechanism of the assembly of this invention, which allows the setting of the housing member 14 in the first wellbore casing 11 reference should be made to FIG. 11 and FIGS. 1*c* and 1*d*. From those FIGS. it can be understood that the selective releasing mechanism, of at least one embodiment of this invention, is in the housing member 14 and is generally referred to as 32. In the process of setting and running the housing member 14 downhole in the first wellbore casing 11 and setting the key body 17 into the up hole apex member 20, which orients and positions the housing member 14 relative to the window 12 and the second wellbore 18, the housing member 14 is brought to a stop. While the housing member 14 is stopped from up or down hole movement and also from rotational movement, the tubular string 15 is allowed to continue it's rotation and transmit its rotational force to sleeve 44 by the lug 37 located on tubular string 15. The sleeve 44 has threads 35 and is positioned proximate a wedge member 33 which has thread members 34. This wedge member 33 is positioned proximate the slip grabbing member 36 in the housing member 14, and thus upon rotation of the tubular string 15 and the sleeve 44, the wedge member 33 is advanced and/or retracted depending on the direction of rotation of the tubular string 15 either against or away from a portion of slip grabbing members 36, which either drives them into the first wellbore casing 11 or away from the first wellbore casing 11. The wedge member 33 is engaged with the housing 14 against rotational movement, but upon rotation of the tubular string 15 and the sleeve 44, once the key body 17 has stopped in the up hole apex 20 or channel member 21, the wedge member 33 can be advanced or retracted by the rotation of the tubular string 15 and sleeve 44. Thus when the housing member 14 is stopped and the tubular string 15 and sleeve 44 within the wedge member 33 are allowed to continue rotation in proximity to the wedge member 33 and between the thread members 34 and 35, the thread member 34 and 35 advance the wedged member 33. As the wedge member 33 drives out releasable slip grabbing members 36, which are located on the housing member 14 and are proximate to the first well bore casing 11 the housing member 14 is locked against movement in the first wellbore casing 11. Thus once the housing member 14 is secured to the well bore casing 11 the tubular string 15 can be used to selectively separate itself from the housing member 14 and sleeve 44 for continued movement in the first wellbore casing 11 and/or into the at least second wellbore 18.

Once the housing member 14 is locked against movement then the tubular string 15 and sleeve 44 continue to rotate with the advancement of the wedge member 33 to drive the slip gripping members 36 into engagement with the first wellbore casing 11 until it begins to bind and put torquing forces on the tubular string 15 through sleeve 44 being stopped from rotation by wedge member 33. Once torquing forces are encountered on the tubular string 15, the tubular string 15 is ready for selective release from the sleeve 44 in the housing member 14. In this embodiment the tubular string 15 has a lug member 37 connected to the tubular string 15, which is positioned in a tubular passage 38 of the sleeve 44 located inside the housing member 14 and a J-slot 39 formed in the sleeve 44 in the housing member 14 proximate the tubular passage 38 for receiving the lug member 37 connected to the tubular string 15 for allowing selective separation of the tubular string 15 from said housing member 14. Thus once loading of tubular string 15 occurs by the sleeve 44 stopping rotation, the operator lets down on and slightly rotates the tubular string 15 and the tubular string 15 with the lug member 37 will be caused to follow the tubular passage 38 to the J-slot 39 to achieve the selective disconnection. After separation of the tubular string 15 from the housing member 14 the tubular string 15 and any reentry member 28 attached thereto is lowered down hole into a deflector member 27, which may be a whip stock 41, connected to the housing member 14, by a fastener 49, for deflecting the reentry member 28 as the reentry member 28 is advanced downward into the deflector member 27 for deflection into the at least second wellbore 18.

It will be appreciated by those skilled in the art that with the tubular string 15 free for down hole movement and deflection into the at least second wellbore 18, that numerous attachments can be connected to the tubular string 15. Those attachments could be reentry member 28 or any attachment desired for the lateral well bore, such as shifting port 56. Thus as shown in FIG. 17 reentry member 28 is a production liner 29 which has been put into the second wellbore 18. The setting of these reentry members 28 are all achieved by downward movement of the tubular string 15 and it's subsequent deflection into the second wellbore 18.

Figure 12A:
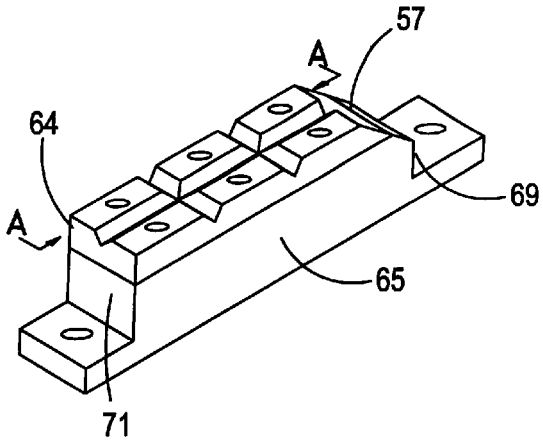
FIG. 12A shows an isometric view of a key body with a shear releasable surface held in place with shear pins for being sheared off should the key body hang up in the up hole apex or window to allow release of the housing from the main well bore.
Figure 12B:
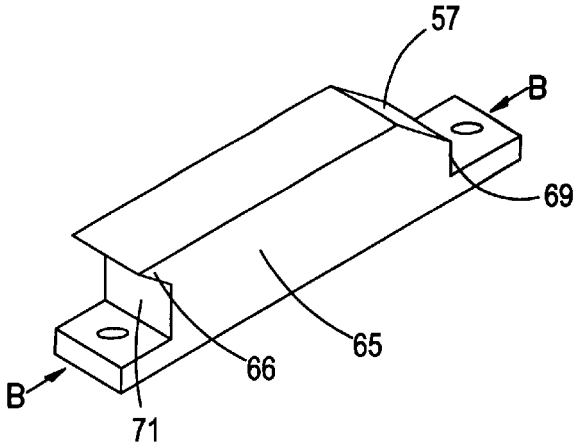
FIG. 12B shows an isometric view of another embodiment of the structure of the key body, having an up hole facing hooked surface member on the key body for engaging the sill of the window upon up hole movement.
Figure 12B:
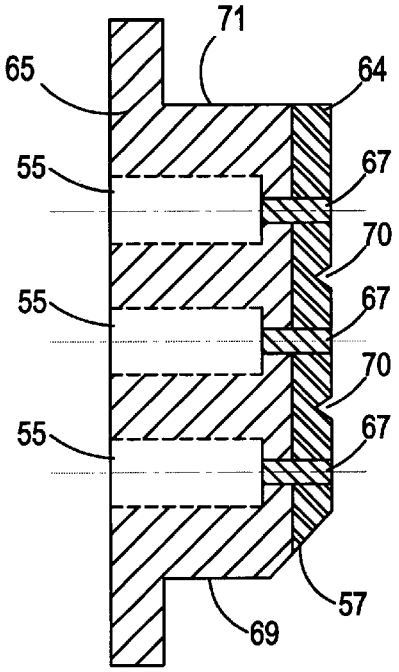
Figure 12B:
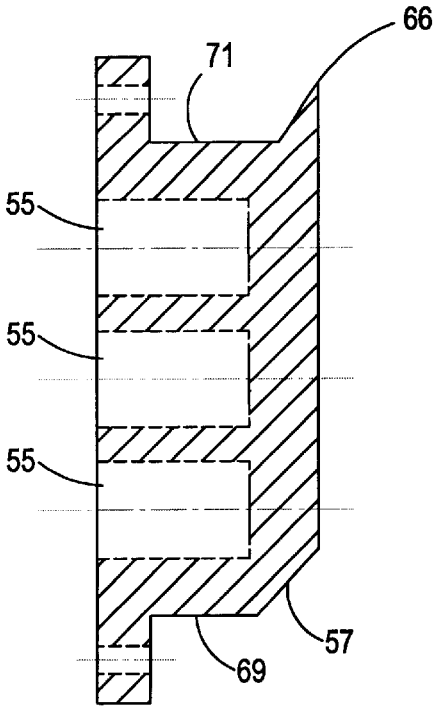
Figure 13:
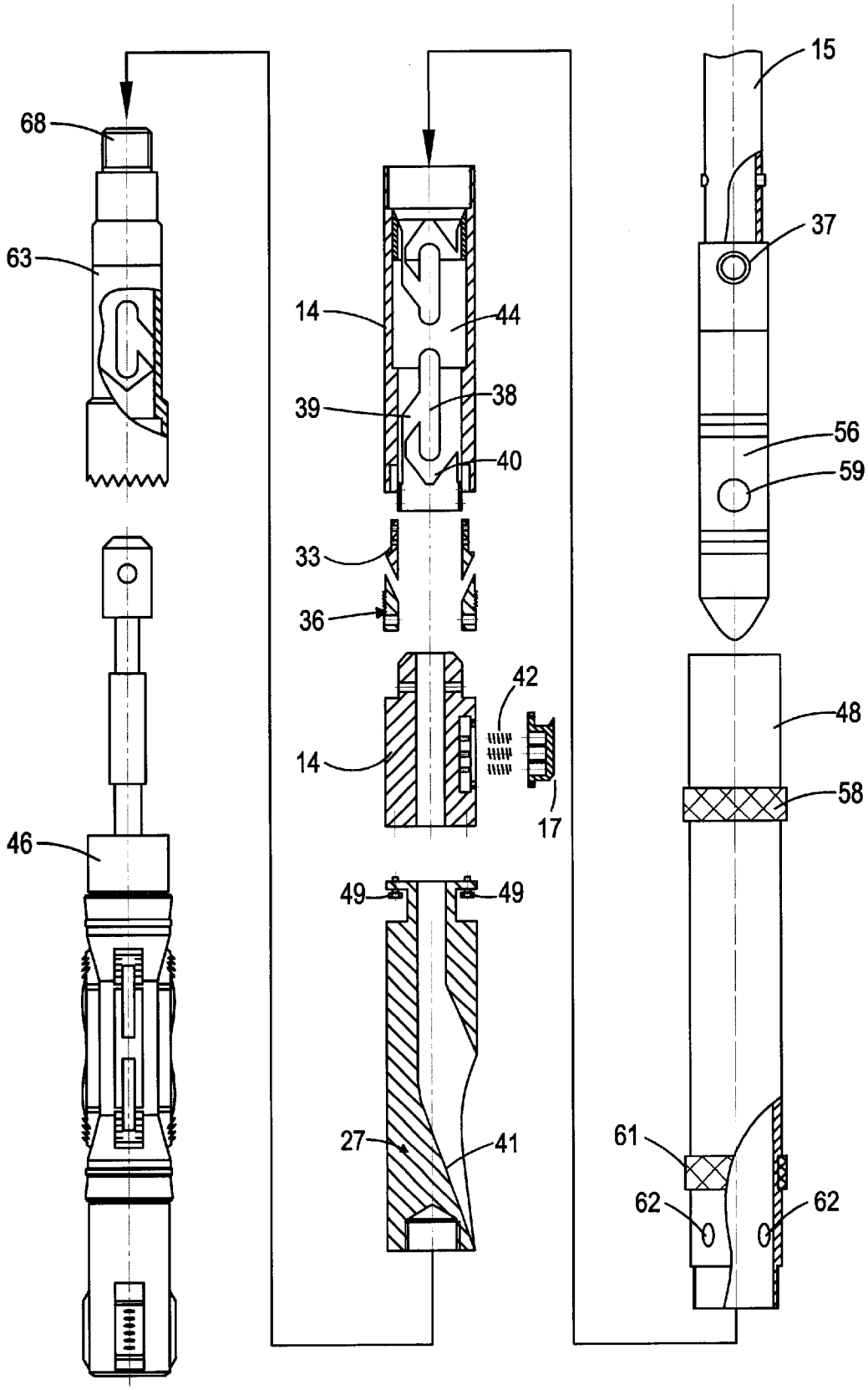
FIG. 13 shows an exploded and cross sectional view of the housing member, key member, resilient spring, deflection member, setting mechanism for the housing member, the selective releasing mechanism of the J-hook, bridge plug, and shifting port and sleeve connected.

Also for a better understanding of the key members 17 reference should be had to FIG. 12 A and B, and FIG. 12A—A and 12B—B where at least two types of key bodies are shown. In certain applications the key member of FIG. 12A would be desirable if there is a possibility of it hanging up and the operator desires to take the extra precaution against such an event. In this key member 17 as shown in FIG. 12A, the upper most surface is composed of a shear able surface member 64 having sufficient thickness above the key body base 65 to engage the sill 13 of the window 12 upon being driven outward of the housing member 14 when mounted to the key body base member 65 and for being capable of being sheared off the key body base member 65 upon sufficient up hole pressure being applied for releasing the housing member 14 for free movement in the first well bore casing 11. The shear able surface member 64 would be held to the key body base member 65 by shear pins 67 with a predetermined shearing force. Further, the shear able surface member 64 may be pre-scored into channeled sections 70 for breaking up the shear able surface member 64 into small pieces which would not be a problem in the well.

In yet other embodiments as show in FIG. 12B the up hole surface 71 of key body 17 may have an up hole hooked portion 66 for engaging the sill 13 of the window 12. In most all applications however the down hole side 69 of key body 17 will have a sloped surface 57 for allowing the key body 17 to be driven inward against the resilient springs 42 located in spring housings 55 upon the housing member 14 being lowered down hole, as shown in FIG. 12A—A or FIG. 12B—B. The sloped surface 57 thus acts as cam as it is driven against the sill 13 of the window 12 which thus allows the housing member 14 and key body 17 to be freed from the window 12 and the sill 13 for free rotational movement in the first wellbore casing 11 away from the window 12. Just for example the free rotation movement may be 180 degrees away from the window 12 which would allow the operator to then either move up hole or down hole with the housing member 14 while the key body 17 is compressed into the spring housings 55 and held there by the first wellbore casing 11.

In the case of reentry for the purpose of a temporary reentry and then withdrawal the assembly of this invention provides for the up hole movement of the tubular string 15 back into the sleeve 44 and housing 14 and it re-attachment to the sleeve 44 for removal of the housing 14 and sleeve 44 and the tubular string 15 from the first wellbore casing 11. This is achieved by the tubular string 15 with the lug member 37 being pulled up hole into the housing 14 until the lug member 37 engages against a mule shoe 40 which is formed on the sleeve 44. As the lug member 37 being pulled up hole by tubing string 15 encounters the mule shoe 40, it is directed back through the J-slot 39 and comes to rest in the tubular passage 38 of the sleeve 44. The lug member 37, which is connected to the tubular string 15 and is positioned in the tubular passage 38 at this point, is sufficiently connected to the housing 14 that continued up hole pulling and rotation retract the wedge members 33 in the opposite manner of its setting, which releases the releasable slip grabbing member 36 for allowing the tubular string 15 to pull the housing 14 and sleeve 44 from the first well bore casing 11 and remove it to the surface, which leaves the wellbore completely free and open for any other additional work to be done either in the at least second wellbore 18 or further downhole in the first wellbore casing 11. It should be understood that before the tubular string 15 can remove the housing 14 and sleeve 44 from the first wellbore casing 11 that the key body 17 must be released from the sill 13 of the window 12. This may be achieved in at least two different ways or in any number of combinations of those ways.

One of those ways is to use a key body 17, as shown in FIG. 12*a* and FIG. 12A—A, which is made of a base key body 65 which has a shearable surface member 64, which has a sufficient thickness above the base key body 65 to engage the sill 13 of the window 12 upon being driven uphole against the up hole apex member 20, but which can be sheared off the base key body 65 with increased uphole pressure so that the housing 14 and sleeve 44 will be freed for free movement with in the first well bore casing 11.

In another embodiments as show in FIG. 12B and FIG. 12*b* the key body 17 is provided on the down hole side 69 of key body 17 with a sloped surface 57 for allowing the key body 17 to be driven inward against the resilient springs 42 located in spring housings 55 upon the housing member 14 being lowered down hole, as shown in FIG. 12A—A or FIG. 12B—B. The sloped surface 57 thus acts as cam as it is driven against the sill 13 of the window 12 which thus allows the housing member 14 and key body 17 to be freed from the window 12 and the sill 13 for free rotational movement in the first wellbore casing 11 away from the window 12. This free rotation movement may be 180 degrees away from the window 12 which would allow the operator to then either move up hole or down hole with the housing member 14 while the key body 17 is compressed into the spring housings 55 and held there by the first wellbore casing 11 and allow the housing 14 and sleeve 44 to be freed for movement in the first wellbore casing 11 and or removal of the housing 14 and sleeve 44 from the first wellbore casing 11.

The assembly for locating lateral wellbores or second wellbores 18 drilled from a main wellbore casing 11 and for orientation and positioning reentry and completion devices for entry into a lateral wellbore or second wellbore 18 and for positioning completion devices with respect to the lateral wellbores is shown in some of its preferred embodiments used with various steps and methods depending on the specific application of the operator. A skilled operator will appreciate that these steps and methods may be used in combination or combinations to achieve the desired results and still be within the scope of the methods of this invention.

In the use of the methods of this assembly for the completion of the main wellbore casing 11 with respect to the second wellbore 18, the housing member 14 and a first completion packer 23 are connected to the tubular string 15 for running the housing member 14 and first completion packer 23 down hole in the main wellbore casing 11. Then as the housing member 14 reaches the open window 12, driving the orientation and positioning member 16 with its key body 17 outward into the window 12 sufficiently for the key body 17 to orient and position the housing member 14 relative to the window 12 in the first wellbore casing 11. Once this is achieved, the operator would commence pulling substantially up hole on the housing 14 and the key body 17 which cause the key body 17 to follow the sill 13 of the window 12 up its convergently curved sides to an up hole apex member 20. Thus once the key body 17 has been pulled substantially up against the up hole apex member 20 or into the channel member 21 formed in the sill 13 of the window 12, the first completion packer 23 would be positioned in the first wellbore casing 11 relative to the lateral wellbore or second wellbore 18 for the final step of setting the first completion packer 23. This setting step of the first completion packer 23 is achieved, as those skilled in the art will understand, by many means known in the art, but the operator must continue holding the key body 17 against the up hole apex member 20 to keep the first completion packer 23 in proper location while the final step of setting the completion packer 23 is accomplished.

In still other uses of the methods of this assembly for completion of the main wellbore casing 11 with respect to the second wellbore 18, the housing member 14, a first completion packer 23 and second completion packer 22 are connected to first production tubing 24, sometimes referred to as the "long string" for running the housing member 14, first completion packer 23, and second completion packer 22 downhole in the main wellbore casing 11. Also at the time of making up the assembly of this embodiment of this invention the second production tubing 25, may be provided, as shown in FIG. 15 to have a production opening 26 formed there in to allow the production of the second wellbore 18 after the setting of the first completion packer 23 and the second completion packer 22 about the junction of the second wellbore 18 and the first wellbore casing 11. Then as the housing member 14 reaches the open window 12, driving the orientation and positioning member 16 with its key body 17 outward into the window 12 sufficiently for the key body 17 to orient and position the housing member 14 relative to the window 12 in the first wellbore casing 11. Once this is achieved, the operator would commence pulling substantially up hole on the housing 14 and the key body 17 which causes the key body 17 to follow the sill 13 of the window 12 up its convergently curved sides to an up hole apex member 20. Thus once the key body 17 has been pulled substantially up against the up hole apex member 20 or into the channel member 21 formed in the sill 13 of the window 12, the first completion packer 23 and second completion packer 22 would be positioned in the first wellbore casing 11 relative to the junction of the lateral wellbore or second wellbore 18 for the final step of setting the first completion packer 23 and second completion packer 22. This setting step of the first completion packer 23 and second completion packer 22 is achieved, as those skilled in the art will understand, by many means known in the art, but the operator must continue holding the key body 17 against the up hole apex member 20 to keep the first completion packer 23 and second completion packer 22 in proper location while the final step of setting the first and second completion packers 23 and 22 is accomplished.

In yet other methods of using this assembly for completing a first wellbore casing 11 and at the same time putting in place a deflection member 27 for entry or reentry into the lateral, is achieved by adding a deflection member 27, which in this case is a whip stock 41, when making up the assembly for running into the main wellbore casing 11. In this method housing member 14, first completion packer 23, and whip stock 41 are connected to the tubular string 15, which in this case would be a first production tubular string 24 as shown representationally in FIG. 16, for running the housing member 14, first completion packer 23, and whip stock 41 down hole in the main wellbore casing 11. Then as the housing member 14 reaches the open window 12, driving the orientation and positioning member 16 with its key body 17 outward into the window 12 sufficiently for the key body 17 to orient and position the housing member 14 relative to the window 12 in the first wellbore casing 11. Once this is achieved, the operator would commence pulling substantially up hole on the housing 14 and the key body 17 which causes the key body 17 to follow the sill 13 of the window 12 up its convergently curved sides to an up hole apex member 20. Thus once the key body 17 has been pulled substantially up against the up hole apex member 20 or into the channel member 21 formed in the sill 13 of the window 12, the first completion packer 23 would be positioned in the first wellbore casing 11 relative to the lateral wellbore or second wellbore 18 for final step of setting the first completion packer 23 and setting the whip stock 41 in the proper orientation to allow the entry or reentry into the second wellbore 18. This setting step of the first completion packer 23 and the entry or reentry into the second wellbore 18 is achieved by various means, as those skilled in the art will understand.

In still further embodiments of the method of use of this invention for completion of the main wellbore casing 11 with respect to the second wellbore 18, the housing member 14, a first and second completion packer 23 and 22, and a deflection member 27, which in this case is a whipstock 41, are connected to the tubular string 15 for running this made up assembly in the main wellbore casing 11. In some cases the tubular string 15 will in fact be a first production tubing 24 and the/first completion packer 23 will have a pass through 43, as shown in FIG. 16, provided therein to allow a tubular material to be passed down hole and through the pass through 43. Then as this assembly is run down hole and reaches the open window 12, driving the orientation and positioning member 16 with its key body 17 outward into the window 12 sufficiently for the key body 17 to orient and position the housing member 14 relative to the window 12 in the first wellbore casing 11. Once this is achieved, the operator would commence pulling substantially up hole on the housing 14 and the key body 17 which causes the key body 17 to follow the sill 13 of the window 12 up its convergently curved sides to an up hole apex member 20. Thus once the key body 17 has been pulled substantially up against the up hole apex member 20 or into the channel member 21 formed in the sill 13 of the window 12, the first and second completion packers 23 and 22 would be positioned in the first wellbore casing 11 relative to the lateral wellbore or second wellbore 18 for the final step of setting the first and second completion packers 23 and 22. Also at the same time the first and second completion packers 23 and 22 are set, deflection member 27, which in this case is a whipstock 41, would be positioned and oriented for deflecting any tubular materials into the second wellbore 18, as can be seen in FIG. 17. As previously discussed, this setting step of the first and second completion packers 23 and 22 is achieved, as those skilled in the art will understand by many means known in the art, while the key body 17 is against the up hole apex member 20 to keep the first and second completion packers 23 and 22 in proper location while the final step of setting the first and second completion packers 23 and 22 is accomplished.

Another use of the methods of this assembly is for the reentry or reentry and completion of the second wellbore 18 with respect to the first wellbore casing 11. In this method housing member 14 and a first completion packer 23 are connected to the tubular string 15 for running said housing member 14 and first completion packer 23 down hole in the main wellbore casing 11. Then as the housing member 14 reaches the open window 12, driving the orientation and positioning member 16 with its key body 17 outward into the window 12 sufficiently for the key body 17 to orient and position the housing member 14 relative to the window 12 in the first wellbore casing 11. Once this is achieved, the operator would commence pulling substantially up hole on the housing 14 and the key body 17 which cause the key body 17 to follow the sill 13 of the window 12 up its convergently curved sides to an up hole apex member 20. Thus once the key body 17 has been pulled substantially up against the up hole apex member 20 or into the channel member 21 formed in the sill 13 of the window 12, the housing is in position to be releasablely set in the first wellbore casing 11. This step is accomplished by holding the key body 17 up hole against the up hole apex member 20 or into the channel member 21, while continuing to rotate the tubular string 15, thus the housing 14 and the key body 17 will be prevented from rotation but the tubular string 15 may be free to rotate and actuate releasable slip grabbing member 36, which releasablely set the housing 14 in the first wellbore casing 11 against up or down hole movement.

Once the housing 14 is set in the first wellbore casing 11, the continued rotation of the tubular string 15 and the sleeve 44, in at least one embodiment actuates a wedge member 33 which allows a J-slot 39 to be used for selectively separating the housing 14 from the tubular string 15 and any reentry members 28 which may be attached to tubular string 15 from the housing 14 for continued movement in the first wellbore casing 11. This movement is continued by lowering said tubular string 15 and the reentry member 28, which as previously discussed may be a second wellbore production liner 29, or any other devise desired to be placed in the second wellbore 18 or first wellbore casing 11. In configurations of this assembly where a deflection member 27, such as a whipstock 41 is used, then the continued downhole movement after the selective separation has occurred between the tubular string 15 and the reentry member 28 will cause deflecting of the tubular string 15 and reentry member 28 from the whipstock 41 and reentering the second wellbore 18 by the tubular string 15 and the reentry member 28 for what ever purpose the operator desires.

Once the operator has achieved all the operations in the second wellbore 18, then the operator may commence the steps of retrieving the tubular string 15 up hole into the housing 14 and reconnecting the tubular string 15 to the housing 14 sufficiently for its removal and the pulling the tubular sting 15 and the housing 14 out of the first wellbore casing 11.

While the preferred embodiments of the invention and the methods of their use have been described for the assembly for locating lateral wellbores drilled from a main wellbore casing for positioning completion members with respect to the lateral wellbore and the main wellbore casing and for orientating and positioning reentry and completion devices for entry into the lateral wellbores, it will be appreciated that other embodiments and methods may be used without departing from the spirit of the invention.

I claim:

1. An assembly for locating lateral well bores drilled from a main wellbore casing for positioning members with respect to said lateral wellbore and said main wellbore casing and for orientating and positioning reentry, completion and work over devices for entry into said lateral well bores comprising, a first wellbore casing means, a window means formed in and through said first wellbore casing means, a sill means formed in said first wellbore casing means for defining said window means in said first wellbore casing means, an up hole apex means formed by said sill means of said window means being convergently curved up hole to said up hole apex means in said first wellbore casing means, at least a second wellbore means proximate and in communication with said window means and extending from said first wellbore casing means, a tubular string means, a housing means movably disposed in said first wellbore casing means for being run into said first wellbore casing means by said tubular string means, and connected to said tubular string means, and a key means connected to said housing for opening in said window means and for being moved up hole in said window means and for following said sill means of said window means toward said up hole apex means in said sill means of said window means in said first well bore casing means for orientating and positioning said housing means relative to said window means upon up hole movement of said housing means.

2. An assembly for locating lateral well bores drilled from a main wellbore casing for positioning members with respect to said lateral wellbore and said main wellbore casing and for orientating and positioning reentry, completion and work over devices for entry into said lateral well bores as in claim 1 further comprising, a key way means located in said up hole apex means of said sill means of said window means in communication with said window means for allowing sliding movement along said sill means of said window means into said key way means.

3. An assembly for locating lateral well bores drilled from a main wellbore casing for positioning members with respect to said lateral wellbore and said main wellbore casing and for orientating and positioning reentry, completion and work over devices for entry into said lateral wellbores as in claim 2 wherein said key way means further comprises, a channel means in communication with said window means and formed as part of said apex means for receiving said key means upon up hole movement of said orientation and positioning means.

4. An assembly for locating lateral well bores drilled from a main wellbore casing for positioning members with respect to said lateral wellbore and said main wellbore casing and for orientating and positioning reentry, completion and work over devices for entry into said lateral well bores as in claim 2 wherein said key means further comprises, a key body means mounted in said housing means for being driven outward therefrom upon said key body means being positioned proximate said window means in said first wellbore casing means.

5. An assembly for locating lateral well bores drilled from a main wellbore casing for positioning members with respect to said lateral wellbore and said main wellbore casing and for orientating and positioning reentry, completion and work over devices for entry into said lateral well bores as in claim 4 wherein said key body means further comprises, a driving means mounted between said housing means and said key body means for driving said key body means outward of said housing means upon said key body means being positioned proximate said window means in said first wellbore casing means.

6. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said key body means further comprises, a hooked means on said key body means having an up hole facing portion for engaging said sill means of said window means and for following said sill means of said window means upon said key body means being moved up hole toward said up hole apex means of said sill means of said window means in said first wellbore casing means for positioning and orientating of said housing means in said first well bore casing means.

7. An assembly for locating lateral well bores drilled from a main wellbore casing for positioning members with respect to said lateral wellbore and said main wellbore casing and for orientating and positioning reentry, completion and work over devices for entry into said lateral well bores as in claim 6 wherein said key body means further comprises, a sloped surface on the down hole portion of said key body means for driving said key body means inward upon down hole motion of said key body means against said sill means formed on said downhole portion of said window means to free said key body means from said window means and allow free movement of said housing means.

8. An assembly for locating lateral well bores drilled from a main wellbore casing for positioning members with respect to said lateral wellbore and said main wellbore casing and for orientating and positioning reentry, completion and work over devices for entry into said lateral well bores as in claim 7 wherein said key body means further comprises, a beveled surface on said down hole side of said key body means for driving said key body means inward upon down hole motion of said key body means against said sill means formed on said downhole portion of said window means to free said key body means from said window means and allow free movement of said housing means.

9. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said key body means further comprises, a key body base means and a shearable surface means having sufficient thickness above said key body base means to engage said sill means of said window means upon being driven outward of said housing means when mounted to said key body base means and for being capable of being sheared off said key body base means upon sufficient up hole pressure being applied for releasing said housing means for free movement in said well bore casing means.

10. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said driving means mounted between said housing means and key body means further comprises, a resilient means for driving said key body means outward of said housing means.

11. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said driving means mounted between said housing means and key body means further comprises, a hydraulic means for driving said key body means outward of said housing means.

12. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said driving means mounted between said housing means and key body means further comprises, a electric means for driving said key body means outward of said housing means.

13. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 further comprising, a completion member means connected to said tubular string means for movement into said first wellbore casing means for completion.

14. An assembly for locating lateral well bores drilled from a main wellbore casing for positioning members with respect to said lateral wellbore and said main wellbore casing and for orientating and positioning reentry, completion and work over devices for entry into said lateral well bores as in claim 13 wherein said completion member comprises, a fluid seal, a bridge plug for receiving said fluid seal and for holding said fluid seal against downhole movement, and a sleeve member connected to said housing means for sealing said lateral well bore means when said housing is lowered in said main well bore casing means.

15. An assembly for locating lateral well bores drilled from a main wellbore casing for positioning members with respect to said lateral wellbore and said main wellbore casing and for orientating and positioning reentry, completion and work over devices for entry into said lateral well bores as in claim 14 wherein said sleeve member further comprises a seal for sealing said window means against fluid flow in said main well bore casing means, and aperture means located down hole on said sleeve member for allowing down hole circulation through said aperture means located down hole for circulating said fluid out of said main well bore casing means.

16. An assembly for locating lateral well bores drilled from a main wellbore casing for positioning members with respect to said lateral wellbore and said main wellbore casing and for orientating and positioning reentry, completion and work over devices for entry into said lateral well bores as in claim 15 further comprising, means on said housing for retrieving said bridge plug from said main well bore casing means.

17. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said completion member means further comprises, a packer means mounted on said housing means up hole of said window means for forming a seal between said packer means and said first wellbore casing means.

18. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 wherein said completion member means further comprises, a first packer means mounted on said housing means up hole of said window means for forming a seal up hole of said window means, and a second packer means mounted on said tubular string means down hole of said window means for forming a seal down hole of said window means.

19. An assembly for locating lateral well bores drilled from a main wellbore casing for positioning members with respect to said lateral wellbore and said main wellbore casing and for orientating and positioning reentry, completion and work over devices for entry into said lateral well bores as in claim 18 further comprising, a deflector means connected to said housing means between said first packer means and said second packer means for deflecting said tubular string means, as said tubular string means is advanced downward into said deflector means for deflection into said at least second wellbore means.

20. An assembly for locating lateral well bores drilled from a main wellbore casing for positioning members with respect to said lateral wellbore and said main wellbore casing and for orientating and positioning reentry, completion and work over devices for entry into said lateral well bores as in claim 5 further comprising, a deflector means connected to said housing means for deflecting said tubular string means, as said tubular string means is advanced downward into said deflector means for deflection into said at least second wellbore means.

21. An assembly for locating lateral well bores drilled from a main wellbore casing for positioning members with respect to said lateral wellbore and said main wellbore casing and for orientating and positioning reentry, completion and work over devices for entry into said lateral well bores comprising, a first wellbore casing means, a window means formed in and through said first wellbore casing means, a sill means formed in said first wellbore casing means for defining said window means in said first wellbore casing means, an up hole apex means formed by said sill means of said window means being convergently curved up hole to said up hole apex means in said first wellbore casing means, at least a second wellbore means proximate and in communication with said window means and extending from said first wellbore casing means, a tubular string means, a housing means movably disposed in said first wellbore casing means for being run into said first wellbore casing means by said tubular string means, and connected to said tubular string means, a key means connected to said housing for opening in said window means and for being moved up hole in said window means and for following said sill means of said window means toward said up hole apex means in said sill means of said window means in said first well bore casing means for orientating and positioning said housing means, and a device means connected to said tubular string means for movement into said first wellbore casing means and said at least said second wellbore means.

22. An assembly for locating lateral well bores drilled from a main wellbore casing for positioning members with respect to said lateral wellbore and said main wellbore casing and for orientating and positioning reentry, completion and work over devices for entry into said lateral well bores as in claim 21 further comprising, a key way means located in said up hole apex means of said sill means of said window means in communication with said window means for allowing sliding movement along said sill means of said window means into said key way means.

23. An assembly for locating lateral well bores drilled from a main wellbore casing for positioning members with respect to said lateral wellbore and said main wellbore casing and for orientating and positioning reentry, completion and work over devices for entry into said lateral well bores as in claim 22 wherein said key way means further comprises, a channel means in communication with said window means and formed as part of said apex means for receiving said key body means upon up hole movement of said key means.

24. An assembly for locating lateral well bores drilled from a main wellbore casing for positioning members with respect to said lateral wellbore and said main wellbore casing and for orientating and positioning reentry, completion and work over devices for entry into said lateral well bores as in claim 23 wherein said key means further comprises, a key body means mounted in said housing means for being driven outward therefrom upon said key body means being positioned proximate said window means in said first wellbore casing means.

25. An assembly for locating lateral well bores drilled from a main wellbore casing for positioning members with respect to said lateral wellbore and said main wellbore casing and for orientating and positioning reentry, completion and work over devices for entry into said lateral well bores as in claim 24 further comprising, a selective separating means connected to said housing means for selective separation of said device means connected to said tubular string means for allowing movement of said device means into said at least said second wellbore means.

26. An assembly for locating lateral well bores drilled from a main wellbore casing for positioning members with respect to said lateral wellbore and said main wellbore casing and for orientating and positioning reentry, completion and work over devices for entry into said lateral well bores as in claim 25 wherein said selective separating means further comprises, a selective releasing means for allowing selective separation of said tubular string means from said housing means.

27. An assembly for locating lateral well bores drilled from a main wellbore casing for positioning members with respect to said lateral wellbore and said main wellbore casing and for orientating and positioning reentry, completion and work over devices for entry into said lateral well bores as in claim 25 wherein said selective separating means further comprises, a selective hydraulic releasing means for allowing selective separation of said tubular string means form said housing means.

28. An assembly for locating lateral well bores drilled from a main wellbore casing for positioning members with respect to said lateral wellbore and said main wellbore casing and for orientating and positioning reentry, completion and work over devices for entry into said lateral well bores as in claim 25 wherein said selective separating means further comprises, a selective shift releasing means for allowing selective separation of said tubular string means from said housing means.

29. An assembly for locating lateral well bores drilled from a main wellbore casing for positioning members with respect to said lateral wellbore and said main wellbore casing and for orientating and positioning reentry, completion and work over devices for entry into said lateral well bores as in claim 28 wherein said selective shifting releasing means further comprises, a lug means connected to said tubular sting means, a tubular passage means located inside said housing means, and a J-slot means formed in said housing means proximate said tubular passage means for receiving said lug means connected to said tubular string means for allowing selective separation of said tubular string means from said housing means.

30. An assembly for locating lateral well bores drilled from a main wellbore casing for positioning members with respect to said lateral wellbore and said main wellbore casing and for orientating and positioning reentry, completion and work over devices for entry into said lateral well bores as in claim 29 wherein said device means connected to said tubular string means further comprises, reentry means for reentry of said at least second wellbore means connected to said tubular string means for reentry into said at least second wellbore means, and a deflector means connected to said housing means for deflecting said reentry means, as said reentry means is selectively separated from said housing means and advanced downward into said deflector means for deflection into said at least second wellbore means.

31. An assembly for locating lateral well bores drilled from a main wellbore casing for positioning members with respect to said lateral wellbore and said main wellbore casing and for orientating and positioning reentry, completion and work over devices for entry into said lateral well bores as in claim 30 further comprising, a mule shoe means located inside said housing means for guiding said lug on said tubular string means, a tubular passage means located inside said housing means for receiving said lug means on said tubular string means, and a slot means formed in said housing means proximate said tubular passage means and for receiving said lug means connected to said tubular string means for allowing selective re-engagement of said tubular string means with said housing means for removal of said housing means from said first wellbore casing means.

32. An assembly for locating lateral well bores drilled from a main wellbore casing for positioning members with respect to said lateral wellbore and said main wellbore casing and for orientating and positioning reentry, completion and work over devices for entry into said lateral well bores as in claim 29 wherein said device means connected to said tubular string means further comprises, work over means for work over of said at least second wellbore means connected to said tubular string means for work over of said at least second wellbore means.

33. An assembly for locating lateral well bores drilled from a main wellbore casing for positioning members with respect to said lateral wellbore and said main wellbore casing and for orientating and positioning reentry, completion and work over devices for entry into said lateral well bores as in claim 29 wherein said device means connected to said tubular string means further comprises, completion means for completion of said at least second wellbore means connected to said tubular string means for completion of said at least second wellbore means.

34. An assembly for locating lateral well bores drilled from a main wellbore casing for positioning members with respect to said lateral wellbore and said main wellbore casing and for orientating and positioning reentry, completion and work over devices for entry into said lateral well bores as in claim 33 wherein said completion means comprises, a shifting port for shifting open and aligning with said second wellbore means for pumping completion fluid there through for completion of said lateral wellbore means.

35. An assembly for locating lateral well bores drilled from a main wellbore casing for positioning members with respect to said lateral wellbore and said main wellbore casing and for orientating and positioning reentry, completion and work over devices for entry into said lateral well bores as in claim 29 further comprising, retrieving means located in said housing means, and a lug means connected to said tubular string means for engaging said retrieving means located in said housing means for removal of said housing means from said first wellbore casing means.

36. An assembly for locating lateral well bores drilled from a main wellbore casing for positioning members with respect to said lateral wellbore and said main wellbore casing and for orientating and positioning reentry, completion and work over devices for entry into said lateral well bores as in claim 28 further comprising, releasable setting means functionally mounted with respect to said housing means for engagement with said first wellbore casing means for setting said housing means against movement in said first wellbore casing means.

37. An assembly for locating lateral well bores drilled from a main wellbore casing for positioning members with respect to said lateral wellbore and said main wellbore casing and for orientating and positioning reentry, completion and work over devices for entry into said lateral well bores as in claim 36 wherein said releasable setting means mounted on said housing means against further movement comprises, releasable slip grabbing means located on said housing means and proximate said first well bore casing means for releasably fixing said housing means in said first wellbore casing means against movement, and means for driving said releasable slip grabbing means outward once said key body means has engaged said key way means located in said up hole apex means.

38. An assembly for locating lateral well bores drilled from a main wellbore casing for positioning members with respect to said lateral wellbore and said main wellbore casing and for orientating and positioning reentry, completion and work over devices for entry into said lateral well bores as in claim 28 wherein said means for driving said releasable slip grabbing means outward further comprises, a wedge means threadably connected to said tubular string means, and thread means formed on said tubular string means for advancing and retracting said wedge means upon rotation of said tubular string means once said key body means in said key way means has stopped said housing means from rotation and has positioned and orientated said housing means in said first wellbore casing.

39. An assembly for locating lateral well bores drilled from a main wellbore casing for positioning members with respect to said lateral wellbore and said main wellbore casing and for orientating and positioning reentry, completion and work over devices for entry into said lateral well bores as in claim 24 wherein said key body means further comprises, a driving means mounted between said housing means and said key body means for driving said key body means outward of said housing means upon said key body means being positioned proximate said window means in said first wellbore casing means.

40. An assembly for locating lateral well bores drilled from a main wellbore casing for positioning members with respect to said lateral wellbore and said main wellbore casing and for orientating and positioning reentry, completion and work over devices for entry into said lateral well bores as in claim 39 wherein said key body means further comprises, a hooked means on said key body means having an up hole facing portion for engaging said sill means of said window means and for following said sill means of said window means upon said key body means being moved up hole toward said up hole apex means of said sill means of said window means in said first wellbore casing means for positioning and orientating of said housing in said first well bore casing means.

41. An assembly for locating lateral well bores drilled from a main wellbore casing for positioning members with respect to said lateral wellbore and said main wellbore casing and for orientating and positioning reentry, completion and work over devices for entry into said lateral well bores as in claim 40 wherein said key body means further comprises, a sloped surface on the down hole portion of said key body means for driving said key body means inward upon down hole motion of said key body means against said sill means formed on said downhole portion of said window means to free said key body means from said window means and allow free movement of said housing means.

42. An assembly for locating lateral well bores drilled from a main wellbore casing for positioning members with respect to said lateral wellbore and said main wellbore casing and for orientating and positioning reentry, completion and work over devices for entry into said lateral well bores as in claim 41 wherein said key body means further comprises, a beveled surface on said down hole side of said key body means for driving said key body means inward upon down hole motion of said key body means against said sill means formed on said downhole portion of said window means to free said key body means from said window means and allow free movement of said housing means.

43. An assembly for locating lateral well bores drilled from a main wellbore casing for positioning members with respect to said lateral wellbore and said main wellbore casing and for orientating and positioning reentry, completion and work over devices for entry into said lateral well bores as in claim 41 wherein said key body means further comprises, a key body base means and a shearable surface means having sufficient thickness above said key body base means to engage said sill means of said window means upon being driven outward of said housing means when mounted to said key body base means and for being capable of being sheared off said key body base means upon sufficient up hole pressure being applied for releasing said housing means for free movement in said well bore casing means.

44. An assembly for locating lateral well bores drilled from a main wellbore casing for positioning members with respect to said lateral wellbore and said main wellbore casing and for orientating and positioning reentry, completion and work over devices for entry into said lateral well bores as in claim 39 wherein said driving means mounted between said housing means and key body means further comprises, a resilient means for driving said key body means outward of said housing means.

45. An assembly for locating lateral well bores drilled from a main wellbore casing for positioning members with respect to said lateral wellbore and said main wellbore casing and for orientating and positioning reentry, completion and work over devices for entry into said lateral well bores as in claim 39 wherein said driving means mounted between said housing means and key body means further comprises, a hydraulic means for driving said key body means outward of said housing means.

46. An assembly for locating lateral well bores drilled from a main wellbore casing for positioning members with respect to said lateral wellbore and said main wellbore casing and for orientating and positioning reentry, completion and work over devices for entry into said lateral well bores as in claim 39 wherein said driving means mounted between said housing means and key body means further comprises, a electric means for driving said key body means outward of said housing means.

47. A method of using an assembly having a tubular string means, a housing means movably disposed in a first wellbore casing means for being run into a first wellbore casing means by said tubular string means and connected to said tubular string means, and a key means, connected to said housing means for locating lateral well bores drilled from a first wellbore casing means and for orientating and positioning reentry, completion, and work over devices for entry into said lateral well bores and for positioning completion devices in said lateral wellbore comprising, running said housing means down hole in said first well bore casing means, said first wellbore casing means having, a window means formed in and through said first wellbore casing means, a sill means formed in said first wellbore casing means for defining said window means in said first wellbore casing means, an up hole convergently curved apex means formed in said sill, and at least a second welbore means proximate and in communication with said window means and extending from said first wellbore casing means, driving said key means connected to said housing means outward from said housing means and toward said window means, and pulling substantially up hole on said driven outward key means for allowing orientation and positioning of said housing means as it follows said window sill to said convergently curved apex means of said window means.

48. The method of claim 47 using an assembly for locating lateral well bores drilled from a main wellbore casing and for orientating and positioning an assembly for locating lateral well bores drilled from a main wellbore casing for positioning members with respect to said lateral wellbore and said main wellbore casing and for orientating and positioning reentry, completion and work over devices for entry into said lateral well bores for entry into said lateral well bores and for positioning completion devices in said lateral wellbore further comprising, holding said key means substantially against said uphole apex means and against rotation of said housing means and said orientation and positioning means, and setting said completion member means connected to said tubular string means for completion.

49. The method of claim 48 using an assembly for locating lateral well bores drilled from a main wellbore casing and for orientating and positioning reentry, completion and work over devices for entry into said lateral well bores and for positioning completion devices in said lateral wellbore wherein setting said completion member means further comprises, setting said packer means connected to said tubular string means for completion.

50. A method of using an assembly having a tubular string means, a housing means movably disposed in a first wellbore casing means for being run into a first wellbore casing means by said tubular string means and connected to said tubular string means, and a key means, connected to said housing means for locating lateral well bores drilled from a first wellbore casing means and for orientating and positioning reentry, completion, and work over devices for entry into said lateral well bores and for positioning completion devices in said lateral wellbore comprising, running said housing means down hole in said first well bore casing means, said first wellbore casing means having, a window means formed in and through said first wellbore casing means, a sill means formed in said first wellbore casing means for defining said window means in said first wellbore casing means, an up hole convergently curved apex means formed in said sill, and at least a second welbore means proximate and in communication with said window means and extending from said first wellbore casing means, driving said key means connected to said housing means outwardly into said window means for orientation and positioning said housing means relative to said window means, pulling substantially up hole on said opened key means for allowing said key means to follow said window sill to said convergently curved apex means of said window means, releasably setting said housing means in said main wellbore casing means against movement in said wellbore casing means, selectively separating said housing means from said tubular string and said device means, and lowering said tubular string means and said device means down hole.

51. The method of claim 50 using an assembly for locating lateral well bores drilled from a main wellbore casing and for orientating and positioning reentry, completion and work over devices for entry into said lateral well bores and for positioning completion devices with respect to said lateral wellbore further comprising, holding said key means substantially against said uphole apex means and against rotation of said key means, rotating said tubing string while said housing is held substantially in position and stationary by said key means, setting said housing means in said first wellbore casing means against up or down hole movement, and separating said tubing string means and said devices means from said housing means.

52. The method of claim 51 using an assembly for locating lateral well bores drilled from a main wellbore casing and for orientating and positioning reentry, completion and work over devices for entry into said lateral well bores and for positioning completion devices with respect to said lateral wellbore further comprising, deflecting said tubular string means and said device means off said deflector means as said tubular string means is lowered downhole.

53. The method of claim 52 using an assembly for locating lateral well bores drilled from a main wellbore casing and for orientating and positioning reentry, completion and work over devices for entry into said lateral well bores and for positioning completion devices with respect to said lateral wellbore further comprising, reentering said at least second wellbore means with said device means as said device means and said tubular string means are deflected off said deflector means as said tubular string means and said device means are lowered downhole.

54. The method of claim 53 using an assembly for locating lateral well bores drilled from a main wellbore casing and for orientating and positioning reentry, completion and work over devices for entry into said lateral well bores and for positioning completion devices with respect to said lateral wellbore further comprising, retrieving said tubular string means up hole into said housing means, reconnecting said tubular string means to said housing means sufficiently for removal, and pulling said tubular string means and said housing means out of said first wellbore casing means.

55. An assembly for locating lateral well bores drilled from a main wellbore casing for positioning members with respect to said lateral wellbore and said main wellbore casing and for orientating and positioning reentry, completion and work over devices for entry into said lateral well bores comprising, a first wellbore casing, a window formed in and through said first wellbore casing means, a sill member formed in said first wellbore casing for defining said window in said first wellbore casing, at least a second wellbore proximate and in communication with said window and extending from said first wellbore casing, a tubular string, a housing member movably disposed in said first wellbore casing for being run into said first wellbore casing by said tubular string, and connected to said tubular string, and a key body connected to said housing member for opening in said window and for being moved up hole in said window and for following said sill member of said window toward said up hole apex member in said sill member of said window in said first well bore casing for orientating and positioning said housing member relative to said window upon up hole movement of said housing.

56. An assembly for locating lateral well bores drilled from a main wellbore casing for positioning members with respect to said lateral wellbore and said main wellbore casing and for orientating and positioning reentry, completion and work over devices for entry into said lateral well bores as in claim 55 further comprising, an up hole key way located in said up hole apex member of said sill member of said window in communication with said window for allowing sliding movement along said sill member of said window into said up hole key way means.

57. An assembly for locating lateral well bores drilled from a main wellbore casing for positioning members with respect to said lateral wellbore and said main wellbore casing and for orientating and positioning reentry, completion and work over devices for entry into said lateral well bores as in claim 56 wherein said up hole key way further comprises, a channel member in communication with said window and formed as part of said apex member for receiving said key member upon up hole movement of said orientation and positioning means.

58. An assembly for locating lateral well bores drilled from a main wellbore casing for positioning members with respect to said lateral wellbore and said main wellbore casing and for orientating and positioning reentry, completion and work over devices for entry into said lateral well bores as in claim 56 wherein said key body further comprises, a key body mounted in said housing for being driven outward therefrom upon said key body being positioned proximate said window in said first wellbore casing.

59. An assembly for locating lateral well bores drilled from a main wellbore casing for positioning members with respect to said lateral wellbore and said main wellbore casing and for orientating and positioning reentry, completion and work over devices for entry into said lateral well bores as in claim 58 wherein said key body further comprises, a driving apparatus mounted between said housing member and said key body for driving said key body outward of said housing member upon said key body being positioned proximate said window in said first wellbore casing.

60. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said key body further comprises, a hooked member on said key body having an up hole facing portion for engaging said sill member of said window and for following said sill member of said window upon said key body being moved up hole toward said up hole apex member of said sill member of said window in said first wellbore casing for positioning and orientating of said housing member in said first well bore casing.

61. An assembly for locating lateral well bores drilled from a main wellbore casing for positioning members with respect to said lateral wellbore and said main wellbore casing and for orientating and positioning reentry, completion and work over devices for entry into said lateral well bores as in claim 60 wherein said key body further comprises, a sloped surface on the down hole portion of said key body for driving said key body inward upon down hole motion of said key body against said sill member formed on said downhole portion of said window member to free said key body from said window and allow free movement of said housing member.

62. An assembly for locating lateral well bores drilled from a main wellbore casing for positioning members with respect to said lateral wellbore and said main wellbore casing and for orientating and positioning reentry, completion and work over devices for entry into said lateral well bores as in claim 61 wherein said key body further comprises, a beveled surface on said down hole side of said key body for driving said key body inward upon down hole motion of said key body against said sill member formed on said downhole portion of said window to free said key body means from said window member and allow free movement of said housing member.

63. An assembly for locating lateral well bores drilled from a main wellbore casing for positioning members with respect to said lateral wellbore and said main wellbore casing and for orientating and positioning reentry, completion and work over devices for entry into said lateral well bores as in claim 62 wherein said key body further comprises, a base key body, and a shearable surface member having sufficient thickness above said base key body to engage said sill member of said window upon being driven outward of said housing member when mounted to said base key body and for being capable of being sheared off said base key body upon sufficient up hole pressure being applied for releasing said housing member for free movement in said well bore casing.

64. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said driving apparatus mounted between said housing member and key body further comprises, a resilient member for driving said key body outward of said housing member.

65. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said driving apparatus mounted between said housing member and key body further comprises, a hydraulic apparatus for driving said key body outward of said housing.

66. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said driving apparatus mounted between said housing member and key body further comprises, an electric apparatus for driving said key body outward of said housing member.

67. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 further comprising, a completion member connected to said tubular string for movement into said first wellbore casing for completion.

68. An assembly for locating lateral well bores drilled from a main wellbore casing for positioning members with respect to said lateral wellbore and said main wellbore casing and for orientating and positioning reentry, completion and work over devices for entry into said lateral well bores as in claim 67 wherein said completion member comprises, a fluid seal, a bridge plug for receiving said fluid seal and for holding said fluid seal against downhole movement, and a sleeve member connected to said housing member for sealing said lateral well bore when said housing is lowered in said main well bore casing.

69. An assembly for locating lateral well bores drilled from a main wellbore casing for positioning members with respect to said lateral wellbore and said main wellbore casing and for orientating and positioning reentry, completion and work over devices for entry into said lateral well bores as in claim 68 wherein said sleeve member further comprises a seal for sealing said window against fluid flow in said main well bore casing, and at least one port located down hole on said sleeve member for allowing down hole circulation through said at least one port located down hole for circulating said fluid out of said main well bore casing.

70. An assembly for locating lateral well bores drilled from a main wellbore casing for positioning members with respect to said lateral wellbore and said main wellbore casing and for orientating and positioning reentry, completion and work over devices for entry into said lateral well bores as in claim 69 further comprising, retrieving member on said housing for retrieving said bridge plug from said main well bore casing.

71. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said completion member further comprises, a packer mounted on said housing member up hole of said window for forming a seal between said packer and said first wellbore casing.

72. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 wherein said completion member further comprises, a first packer mounted on said housing member up hole of said window member for forming a seal up hole of said window member, and a second packer mounted on said tubular string down hole of said window member for forming a seal down hole of said window member.

73. An assembly for locating lateral well bores drilled from a main wellbore casing for positioning members with respect to said lateral wellbore and said main wellbore casing and for orientating and positioning reentry, completion and work over devices for entry into said lateral well bores as in claim 72 further comprising, a deflector member connected to said housing member between said first packer and said second packer for deflecting said tubular string, as said tubular string is advanced downward into said deflector member for deflection into said at least second wellbore.

74. An assembly for locating lateral well bores drilled from a main wellbore casing for positioning members with respect to said lateral wellbore and said main wellbore casing and for orientating and positioning reentry, completion and work over devices for entry into said lateral well bores as in claim 59 further comprising, a deflector member connected to said housing member for deflecting said tubular string, as said tubular string is advanced downward into said deflector member for deflection into said at least second wellbore.

75. An assembly for locating lateral well bores drilled from a main wellbore casing for positioning members with respect to said lateral wellbore and said main wellbore casing and for orientating and positioning reentry, completion and work over devices for entry into said lateral well bores comprising, a first wellbore casing, a window formed in and through said first wellbore casing means, a sill member formed in said first wellbore casing for defining said window in said first wellbore casing, an up hole apex member formed by said sill member of said window being convergently curved up hole to said up hole apex member in said first wellbore casing, a tubular string, a housing member movably disposed in said first wellbore casing for being run into said first wellbore casing by said tubular string, and connected to said tubular string, a key body connected to housing member for opening in said window means and for being moved up hole in said window and for following said sill member of said window means toward said up hole apex member in said sill member of said window member in said first well bore casing for orientating and positioning said housing member relative to said window upon_up hole movement of said housing member and said tubular string, and a device member connected to said tubular string for movement into said first wellbore casing and said at least said second wellbore.

76. An assembly for locating lateral well bores drilled from a main wellbore casing for positioning members with respect to said lateral wellbore and said main wellbore casing and for orientating and positioning reentry, completion and work over devices for entry into said lateral well bores as in claim 75 further comprising a up hole key way member located in said up hole apex member of said sill member of said window in communication with said window for allowing sliding movement along said sill member of said window into said key way member.

77. An assembly for locating lateral well bores drilled from a main wellbore casing for positioning members with respect to said lateral wellbore and said main wellbore casing and for orientating and positioning reentry, completion and work over devices for entry into said lateral well bores as in claim 76 wherein said up hole key way member further comprises, a channel member in communication with said window and formed as part of said apex member for receiving said key body upon up hole movement of said orientation and positioning member.

78. An assembly for locating lateral well bores drilled from a main wellbore casing for positioning members with respect to said lateral wellbore and said main wellbore casing and for orientating and positioning reentry, completion and work over devices for entry into said lateral well bores as in claim 77 wherein said key body further comprises, a key body mounted in said housing member for being driven outward therefrom upon said key body being positioned proximate said window in said first wellbore casing.

79. An assembly for locating lateral well bores drilled from a main wellbore casing for positioning members with respect to said lateral wellbore and said main wellbore casing and for orientating and positioning reentry, completion and work over devices for entry into said lateral well bores as in claim 78 further comprising, a selective separating apparatus connected to said housing member for selective separation of said member connected to said tubular string for allowing movement of said member into said at least said second wellbore.

80. An assembly for locating lateral well bores drilled from a main wellbore casing for positioning members with respect to said lateral wellbore and said main wellbore casing and for orientating and positioning reentry, completion and work over devices for entry into said lateral well bores as in claim 79 wherein said key body further comprises, a driving apparatus mounted between said housing member and said key body for driving said key body outward of said housing member upon said key body being positioned proximate said window in said first wellbore casing.

81. An assembly for locating lateral well bores drilled from a main wellbore casing for positioning members with respect to said lateral wellbore and said main wellbore casing and for orientating and positioning reentry, completion and work over devices for entry into said lateral well bores as in claim 80 wherein said key body further comprises, a hooked member on said key body having an up hole facing portion for engaging said sill member of said window and for following said sill member of said window upon said key body being moved up hole toward said up hole apex member of said sill member of said window in said first wellbore casing for positioning and orientating of said housing member in said first well bore casing.

82. An assembly for locating lateral well bores drilled from a main wellbore casing for positioning members with respect to said lateral wellbore and said main wellbore casing and for orientating and positioning reentry, completion and work over devices for entry into said lateral well bores as in claim 81 wherein said key body further comprises, a sloped surface on the down hole portion of said key body for driving said key body inward upon down hole motion of said key body against said sill member formed on said downhole portion of said window to free said key body from said window and allow free movement of said housing member.

83. An assembly for locating lateral well bores drilled from a main wellbore casing for positioning members with respect to said lateral wellbore and said main wellbore casing and for orientating and positioning reentry, completion and work over devices for entry into said lateral well bores as in claim 82 wherein said key body further comprises, a beveled surface on said down hole side of said key body for driving said key body inward upon down hole motion of said key body against said sill member formed on said downhole portion of said window member to free said key body from said window member and allow free movement of said housing member.

84. An assembly for locating lateral well bores drilled from a main wellbore casing for positioning members with respect to said lateral wellbore and said main wellbore casing and for orientating and positioning reentry, completion and work over devices for entry into said lateral well bores as in claim 83 wherein said key body further comprises, a base key body and a shear able surface member having sufficient thickness above said base key body to engage said sill member of said window upon being driven outward of said housing member when mounted to said base key body and for being capable of being sheared off said base key body upon sufficient up hole pressure being applied for releasing said housing member for free movement in said well bore casing.

85. An assembly for locating lateral well bores drilled from a main wellbore casing for positioning members with respect to said lateral wellbore and said main wellbore casing and for orientating and positioning reentry, completion and work over devices for entry into said lateral well bores as in claim 84 wherein said driving means mounted between said housing means and key body means further comprises, a resilient means for driving said key body means outward of said housing means.

86. An assembly for locating lateral well bores drilled from a main wellbore casing for positioning members with respect to said lateral wellbore and said main wellbore casing and for orientating and positioning reentry, completion and work over devices for entry into said lateral well bores as in claim 84 wherein said driving means mounted between said housing member and key body further comprises, a hydraulic apparatus for driving said key body outward of said housing member.

87. An assembly for locating lateral well bores drilled from a main wellbore casing for positioning members with respect to said lateral wellbore and said main wellbore casing and for orientating and positioning reentry, completion and work over devices for entry into said lateral well bores as in claim 84 wherein said driving means mounted between said housing member and key body member further comprises, a electric apparatus for driving said key body outward of said housing member.

88. An assembly for locating lateral well bores drilled from a main wellbore casing for positioning members with respect to said lateral wellbore and said main wellbore casing and for orientating and positioning reentry, completion and work over devices for entry into said lateral well bores as in claim 79 wherein said selective separating means further comprises, a selective releasing apparatus for allowing selective separation of said tubular string means from said housing member.

89. An assembly for locating lateral well bores drilled from a main wellbore casing for positioning members with respect to said lateral wellbore and said main wellbore casing and for orientating and positioning reentry, completion and work over devices for entry into said lateral well bores as in claim 79 wherein said selective separating apparatus further comprises, a selective hydraulic releasing apparatus for allowing selective separation of said tubular string member from said housing member.

90. An assembly for locating lateral well bores drilled from a main wellbore casing for positioning members with respect to said lateral wellbore and said main wellbore casing and for orientating and positioning reentry, completion and work over devices for entry into said lateral well bores as in claim 79 wherein said selective separating apparatus further comprises, a selective shift releasing apparatus for allowing selective separation of said tubular string from said housing member.

91. An assembly for locating lateral well bores drilled from a main wellbore casing for positioning members with respect to said lateral wellbore and said main wellbore casing and for orientating and positioning reentry, completion and work over devices for entry into said lateral well bores as in claim 90 wherein said selective shifting releasing apparatus further comprises, a lug member connected to said tubular sting, a tubular passage located inside said housing member, and a J-slot formed in said housing member proximate said tubular passage member for receiving said lug member connected to said tubular string for allowing selective separation of said tubular string from said housing member.

92. An assembly for locating lateral well bores drilled from a main wellbore casing for positioning members with respect to said lateral wellbore and said main wellbore casing and for orientating and positioning reentry, completion and work over devices for entry into said lateral well bores as in claim 91 further comprising, releasable setting apparatus functionally mounted with respect to said housing member for engagement with said first wellbore casing member for setting said housing member against movement in said first wellbore casing member.

93. An assembly for locating lateral well bores drilled from a main wellbore casing for positioning members with respect to said lateral wellbore and said main wellbore casing and for orientating and positioning reentry, completion and work over devices for entry into said lateral well bores as in claim 92 wherein said releasable setting apparatus mounted on said housing member against further movement comprises, releasable slip grabbing members located on said housing member and proximate said first well bore casing for releasably fixing said housing member in said first wellbore casing against movement, and driving member for driving said releasable slip grabbing members outward once said key body means has engaged said key way member located in said up hole apex member.

94. An assembly for locating lateral well bores drilled from a main wellbore casing for positioning members with respect to said lateral wellbore and said main wellbore casing and for orientating and positioning reentry, completion and work over devices for entry into said lateral well bores as in claim 91 further comprising, retrieving apparatus located in said housing member, a lug member connected to said tubular string for engaging said retrieving apparatus located in said housing member for removal of said housing member from said first wellbore casing.

95. An assembly for locating lateral well bores drilled from a main wellbore casing for positioning members with respect to said lateral wellbore and said main wellbore casing and for orientating and positioning reentry, completion and work over devices for entry into said lateral well bores as in claim 90 wherein said means for driving said releasable slip grabbing members outward further comprises, a wedge member threadably connected to said tubular string, and threaded members for advancing and retracting said wedge means upon rotation of said tubular string once said key body in said key way member has stopped said housing member from rotation and has positioned and orientated said housing member in said first wellbore casing.

96. An assembly for locating lateral well bores drilled from a main wellbore casing for positioning members with respect to said lateral wellbore and said main wellbore casing and for orientating and positioning reentry, completion and work over devices for entry into said lateral well bores as in claim 75 wherein said device member connected to said tubular string further comprises, reentry members for reentry of said at least second wellbore connected to said tubular string for reentry into said at least second wellbore, and a deflector member connected to said housing member for deflecting said reentry member, as said reentry member is selectively separated from said housing member and advanced downward into said deflector member for deflection into said at least second wellbore member.

97. An assembly for locating lateral well bores drilled from a main wellbore casing for positioning members with respect to said lateral wellbore and said main wellbore casing and for orientating and positioning reentry, completion and work over devices for entry into said lateral well bores as in claim 96 further comprising, a mule shoe member located inside said housing member for guiding said lug on said tubular string, a tubular passage member located inside said housing member for receiving said lug member on said tubular string member, and a slot formed in said housing member proximate said tubular passage member and for receiving said lug member connected to said tubular string for allowing selective re-engagement of said tubular string with said housing member for removal of said housing member from said first wellbore casing.

98. An assembly for locating lateral well bores drilled from a main wellbore casing for positioning members with respect to said lateral wellbore and said main wellbore casing and for orientating and positioning reentry, completion and work over devices for entry into said lateral well bores as in claim 75 wherein said device member connected to said tubular string means further comprises, work over member for work over of said at least second wellbore member connected to said tubular string for work over of said at least second wellbore.

99. An assembly for locating lateral well bores drilled from a main wellbore casing for positioning members with respect to said lateral wellbore and said main wellbore casing and for orientating and positioning reentry, completion and work over devices for entry into said lateral well bores as in claim 75 wherein said device member connected to said tubular string further comprises, a completion member for completion of said at least second wellbore connected to said tubular string for completion of said at least second wellbore.

100. An assembly for locating lateral well bores drilled from a main wellbore casing for positioning members with respect to said lateral wellbore and said main wellbore casing and for orientating and positioning reentry, completion and work over devices for entry into said lateral well bores as in claim 99 wherein said completion member comprises, a shifting port for shifting open and aligning with said second wellbore for pumping completion fluid there through for completion of said lateral wellbore.

* * * * *